US005957103A

United States Patent [19]

Takami et al.

[11] Patent Number: 5,957,103

[45] Date of Patent: Sep. 28, 1999

[54] INTERNAL COMBUSTION ENGINE CYLINDER BLOCK AND MANUFACTURING METHOD

[75] Inventors: Toshihiro Takami, Toyota; Mitsuhiro Karaki, Okazaki; Masamitu Kenmochi, Toyota; Koichiro Sasada, Aichi-Ken, all of Japan

[73] Assignee: Toyota Jidosha Kabushiki Kaisha, Toyota, Japan

[21] Appl. No.: 08/951,513

[22] Filed: Oct. 16, 1997

[30] Foreign Application Priority Data

Oct. 16, 1996 [JP] Japan ..... 8-273645

[51] Int. Cl.[6] ..... F02F 1/14

[52] U.S. Cl. ..... 123/193.2; 164/94

[58] Field of Search ..... 123/193.2; 164/93, 164/94

[56] References Cited

U.S. PATENT DOCUMENTS

| | | | |
|---|---|---|---|
| 1,721,197 | 7/1929 | Almen | 29/405 |
| 4,005,991 | 2/1977 | Uebayasi et al. | 29/196.2 |
| 4,023,613 | 5/1977 | Uebayasi | 164/100 |
| 4,469,060 | 9/1984 | Jordan | 123/193 |
| 4,505,238 | 3/1985 | Jordan | 123/193 |
| 5,291,862 | 3/1994 | Katoh et al. | 123/193.2 |
| 5,357,921 | 10/1994 | Katoh et al. | 123/193.2 |
| 5,562,073 | 10/1996 | Van Bezeij et al. | 123/19.2 |

FOREIGN PATENT DOCUMENTS

| | | |
|---|---|---|
| 0 544 575 A1 | 8/1993 | European Pat. Off. . |
| 1-28289 | 8/1989 | Japan . |

*Primary Examiner*—Henry C. Yuen
*Assistant Examiner*—Arnold Castro
*Attorney, Agent, or Firm*—Pillsbury Madison & Sutro LLP

[57] ABSTRACT

A cylinder block of an internal combustion engine has a portion between a cylinder block body and a cylinder liner which is sealed against a coolant so as to prevent the coolant from entering a crank case. The cylinder block body is made of a first material. The cylinder liner is cast in the cylinder block body. The cylinder liner is made of a second material different from the first material. The cylinder liner has an engaging portion contacting a portion of the cylinder block body from outside in a radial direction of the cylinder liner.

14 Claims, 26 Drawing Sheets

INTERNAL COMBUSTION ENGINE CYLINDER BLOCK AND MANUFACTURING METHOD

BACKGROUND OF THE INVENTION

1. Field of the Invention

The present invention relates to a cylinder block of an internal combustion engine and, more particularly, to a semi-wet liner type cylinder block in which a cylinder liner is integrally cast and a method for manufacturing such a cylinder liner.

2. Description of the Related Art

Conventionally, a wet liner type cylinder block is a known type of cylinder block for an internal combustion engine. In the wet liner type cylinder block, the cylinder liner is cooled directly by coolant in a water jacket by locating the cylinder liner so that at least a part of the cylinder liner is exposed to the water jacket. Such a wet liner type cylinder block can be manufactured by integrally casting a cylinder liner in a cylinder block body as disclosed in Japanese Laid-Open Patent Application No.5-177334.

Generally, a cylinder block body is made of an aluminum alloy in order to reduce its weight, whereas a cylinder liner is made of cast iron to provide an anti-abrasion characteristic. Since aluminum alloy has a thermal expansion coefficient greater than that of cast iron, the cylinder block body expands more than the cylinder liner when a temperature of the cylinder liner is increased due to operation of the internal combustion engine. As mentioned above, the conventional cylinder block is manufactured by integrally casting the cylinder liner in the cylinder block. Thus, when the cylinder block body expands further than the cylinder liner, it is possible that a gap is formed between the cylinder block body and the cylinder liner. Since an outer surface of the cylinder liner is exposed to the water jacket, an interface between the cylinder block body and the cylinder liner is exposed to the water jacket. Accordingly, if a gap is formed between the cylinder block body and the cylinder liner, it is possible that a coolant can intrude into the crank case via the gap.

SUMMARY OF THE INVENTION

It is a general object of the present invention to provide an improved and useful cylinder block of an internal combustion engine and a manufacturing method therefor in which the above-mentioned problems are eliminated.

A more specific object of the present invention is to provide a cylinder block and a manufacturing method therefor in which a portion between the cylinder block body and the cylinder liner is sealed against coolant entry, and thereby the coolant is prevented from intruding into the crank case.

In order to achieve the above-mentioned objects, there is provided according to the present invention a cylinder block of an internal combustion engine, comprising:

a cylinder block body made of a first material; and a cylinder liner cast in the cylinder block body, the cylinder liner made of a second material different from the first material, the cylinder liner having an engaging portion contacting a portion of the cylinder block body from outside in a radial direction of the cylinder liner.

According to the above-mentioned invention, the cylinder liner has the engaging portion which engages a portion of the cylinder block body from outside in a radial direction. Accordingly, when the cylinder block body expands further than the cylinder liner, the portion of the cylinder block body tightly contacts the engaging portion of the cylinder liner. Thereby, a seal against the coolant is provided at an interface between the cylinder block body and the cylinder liner.

In one embodiment according to the present invention, the engaging portion may comprise a protrusion protruding outwardly from an outer surface of the cylinder liner in a radial direction, the protrusion having an end portion extending in a direction of a longitudinal axis of the cylinder liner.

According to this invention, the end portion of the protrusion engages the portion of the cylinder block body from outside of the portion of the cylinder block body in a radial direction. Thereby, a seal against the coolant is positively provided at an interface between the portion of the cylinder block body and the end of the protrusion protruding from the cylinder liner.

Additionally, the engaging portion may comprise a hollow space formed in the cylinder liner, the hollow space having an opening in an outer surface of the cylinder liner, an area of the hollow space being greater than an area of the opening when viewed in a radial direction of the cylinder liner.

In one embodiment according to the present invention, the engaging portion may include a first protrusion and a second protrusion adjacent to the first protrusion, the first and second protrusions protruding outwardly from an outer surface of the cylinder liner, each of the first and second protrusions having an end portion extending in opposite directions toward each other in a direction of a longitudinal axis of the cylinder liner.

According to this invention, a seal can be provided between the portion of the cylinder block body protruding through a portion between the first and second protrusions.

Additionally, each of the first and second protrusion has an undercut portion in an area connecting to the outer surface of the cylinder liner when viewed from outside in a radial direction of the cylinder liner.

According to this invention, the cylinder liner engages the cylinder block body from outside in a radial direction in the undercut portion as well as the end portions of the first and second protrusions. Thus the number of sealing portions is increased, resulting in a positive seal against the coolant.

In one embodiment according to the present invention, an uneven portion is provided to the outer surface of the cylinder liner between the first and second protrusions along a circumferential direction of the cylinder liner.

Accordingly, a relative displacement between the cylinder liner and the cylinder block body in the circumferential direction is prevented by the unevenness. When expansion occurs in the cylinder block body that is greater than an expansion in the cylinder liner, a relative displacement occurs in the interface between the cylinder liner and the cylinder block body in the circumferential direction as well as in a radial direction. Accordingly, if the relative displacement in a radial direction is restricted, the relative displacement in the circumferential direction can be restricted. Thereby, formation of a gap in an interface between the cylinder block and the cylinder liner is prevented, resulting in an improved sealing effect against entry of the coolant at the interface.

In one embodiment according to the present invention, the engaging portion may include a first protrusion and a second protrusion adjacent to the first protrusion, the first and second protrusions protruding outwardly from an outer surface of the cylinder liner, the first and second protrusions slanting toward each other.

Additionally, in one embodiment according to the present invention, the engaging portion may include a circumferentially extending portion connected to an outer surface of the cylinder liner, the circumferentially extending portion being positioned a predetermined distance away from the outer surface of the cylinder liner in a radial direction of the cylinder liner, the circumferentially extending portion having a plurality of openings connecting outside and inside of the circumferentially extending portion.

Accordingly, the circumferentially extending portion engages a portion of the cylinder block body located inside the circumferentially extending portion from outside in a radial direction. Thus, a positive sealing effect is provided between the circumferentially extending portion and the portion of the cylinder block body.

Additionally, the predetermined distance may be greater than a width of a portion of the cylinder block body positioned on the outside of the circumferentially extending portion, the width being measured in a radial direction of the cylinder liner.

When the cylinder liner is cast, the molten metal is introduced into a space between the circumferentially extending portion and an outer surface of the cylinder liner through the openings formed in the circumferentially extending portion. In a cooling process after the molten metal is filled, a flow of the molten metal occurs in a direction from outside the circumferentially extending portion to the space between the circumferentially extending portion via the openings due to the shrinkage of the molten metal in a radially inward direction. Thus, a good sealing effect is obtained in an area adjacent to the openings.

In one embodiment according to the present invention, the circumferentially extending portion may be connected to the cylinder at opposite sides thereof.

Alternatively, the circumferentially extending portion may be connected to the cylinder liner by a single rib at a middle position between opposite sides of the circumferentially extending portion.

Additionally, the circumferentially extending portion may be connected to the cylinder liner by a plurality of ribs each of which extends in a direction parallel to a longitudinal axis of the cylinder liner.

Further, in the cylinder block according to the present invention an uneven portion may be provided on an outer surface of the cylinder liner in a portion contacting the cylinder block body in a circumferential direction.

According to another aspect of the present invention, there is provided according to the present invention a method for manufacturing a cylinder block of an internal combustion engine, comprising:

a cylinder block body made of a first material; and a cylinder liner cast in the cylinder block body, the cylinder liner made of a second material different from the first material, the cylinder liner having an engaging portion contacting a portion of the cylinder block body from outside in a radial direction of the cylinder liner, the method comprising:

a first step of placing a core in a predetermined position inside a mold, the core having an inner surface adapted for forming the engaging portion;

a second step of die matching a liner pattern with respect to the core, the liner pattern having a contour substantially the same as the cylinder liner other than a portion corresponding to the engaging portion, the liner pattern comprising a combination of a plurality of pieces so that the liner pattern is die matched by positioning each of the pieces in a predetermined position inside the core;

a third step of forming an outer surface forming mold corresponding to an outer surface of the cylinder liner by filling a mold material in a cavity formed between the mold and each of the core and the liner pattern and solidifying the mold material in the cavity so as to utilize the mold material and the core;

a fourth step of removing the liner pattern from the mold;

a fifth step of placing an inner surface die in a predetermined position inside the outer surface forming mold, the inner surface die having a contour substantially the same as a contour of an inner surface of the cylinder liner;

a sixth step of forming a liner forming mold by filling a mold material in the inner surface die so as to form an inner surface mold having a contour substantially the same as the contour of the inner surface of the cylinder liner and solidifying the mold material in the inner surface die so as to utilize the outer surface forming mold and the inner surface forming mold;

a seventh step of casting the cylinder liner by filling molten metal in a cavity formed by the outer surface forming mold and the inner surface forming mold of the liner molding mold; and an eighth step of insertion casting the cylinder block with the cylinder liner inserted in the cylinder block.

In this invention, the liner pattern is divided into a plurality of pieces. Thus, die matching of the liner pattern inside the core can be achieved by arranging each piece of the liner pattern in a predetermined position inside the core. Then, in the third step, the mold forming the engaging portion of the cylinder liner is formed by the inner surface of the core. Additionally, the mold which forms the outer surface of the cylinder liner other than the engaging portion is formed by the mold material filled around the liner pattern. These molds are unutilized so that the mold for forming the outer surface of the cylinder liner is formed. By using the outer surface forming mold, the cylinder liner having the engaging portion can be formed which engaging portion engages the cylinder block body from outside in a radial direction.

Other objects, features and advantages of the present invention will become more apparent from the following detailed description when read in conjunction with the accompanying drawings.

DETAILED DESCRIPTION OF THE PREFERRED EMBODIMENTS

Figure 1:
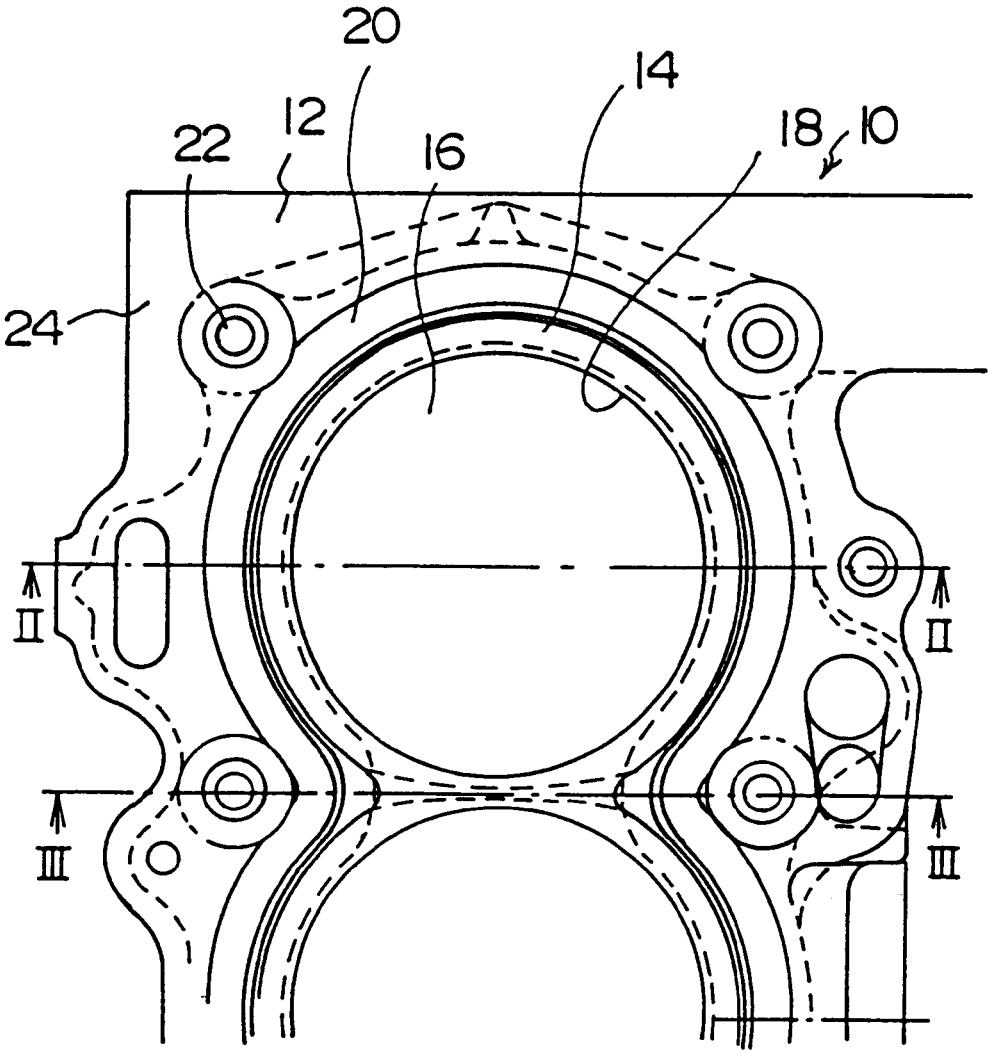
FIG. 1 is a plan view of a cylinder block according to a first embodiment of the present invention.
Figure 2:
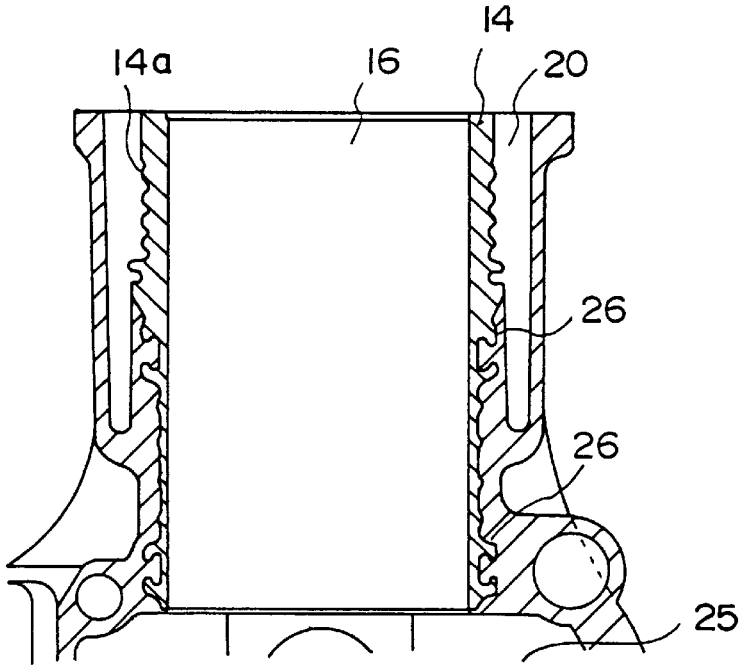
FIG. 2 is a cross-sectional view taken along a line II—II of FIG. 1.
Figure 3:
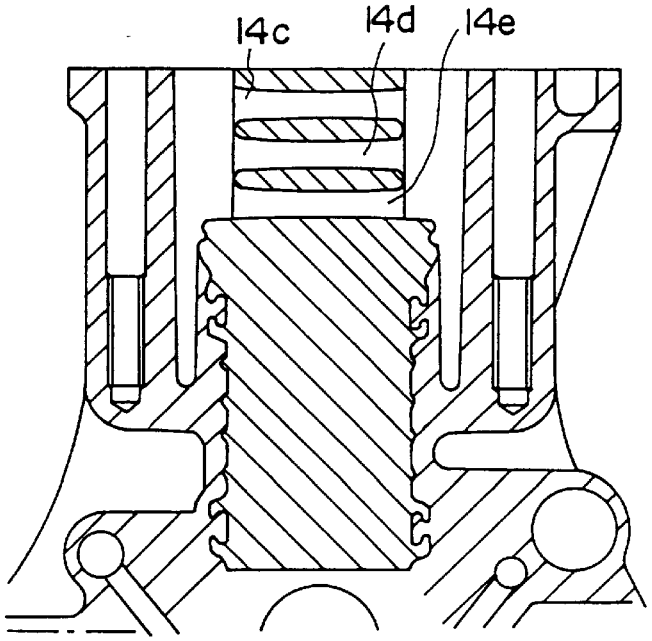
FIG. 3 is a cross-sectional view taken along a line III—III of FIG. 2.

A description will now be given, with reference to FIGS. 1 to 4, of a double cylinder type cylinder block 10 according to a first embodiment of the present invention. It should be noted that the present invention can be applied to a single cylinder type cylinder block or a multiple cylinder type cylinder block having a plurality of cylinders. FIG. 1 is a plane view of a part of the cylinder block 10. FIGS. 2 and 3 are cross-sectional views of the cylinder block 10 taken along a line II and a line III of FIG. 1, respectively.

As shown in FIGS. 1–3, the cylinder block 10 is constructed by casting cylinder liners 14 which are made of cast iron into a cylinder block body 12 which is made of aluminum alloy. The cylinder block body 12 has two cylinders 16. The cylinder liners 14 are provided on an inner side of a corresponding cylinder 16. The cylinder liner 14 provides, on an inner side thereof, a cylinder bore 18 in which a piston (not shown in the figures) is movable therein, and provides a part of an inner wall of a water jacket 20 on an outer side thereof. Bolt holes 22 are provided around the water jacket 20 for mounting a cylinder head (not shown in the figures). The above-mentioned cylinder 16, water jacket 20 and bolt holes 22 are open in a deck surface 24 of the cylinder block body 12.

As shown in FIG. 2, a plurality of ribs 14*a* are provided on a portion of an outer surface of the cylinder liner 14 which faces the water jacket 20. Since the ribs 14*a* are provided, a contact area between the cylinder liner and the coolant is increased, and thereby a cooling effect of the coolant is increased. A crank case 25 is provided in a portion under the cylinder 16 of the cylinder block 10 in FIG. 2. Additionally, an engaging portion 26 is provided around the entire circumference of a portion of the cylinder liner 14, the engaging portion being cast within the cylinder block body 12. The structure of the engaging portion 26 will be described later.

As shown in FIG. 3, the cylinder liner 14 has inter-bore water passages 14*c*, 14*d* and 14*e* which pass through a boundary portion between the adjacent cylinder bores in left and right directions in the figure. Since the inter-bore water passages 14*c*–14*e* are provided, a cooling effect is provided even in the boundary portion between the adjacent cylinder bores.

It should be noted that the cylinder block 10 is cast by poring molten metal into a cavity formed between the cylinder liner 14 and a mold in a state where the cylinder liner 14 is placed in the mold with a core for forming the water jacket around the cylinder liner 14.

When the internal combustion engine is operated, a temperature of the cylinder block is increased. As mentioned above, the cylinder block body 12 is made of aluminum alloy, whereas the cylinder liner is made of cast iron. Since the thermal expansion coefficient of aluminum alloy is greater than the thermal expansion coefficient of cast iron, the cylinder block body 12 expands further than the cylinder liner 14. Accordingly, it is possible that a gap is formed between the cylinder block body 12 and the cylinder liner 14. Since the cylinder liner 14 constitutes a part of the inner wall of the water jacket 20 as mentioned above, the interface between the cylinder liner 14 and the cylinder block body 12 is exposed to the water jacket 20. Additionally, as shown in FIG. 2, a lower end of the interface between the cylinder liner 14 and the cylinder block body 12 is exposed to the crank case 25. Thus, if a gap is formed between the cylinder liner 14 and the cylinder block body 12, it is possible that a coolant in the water jacket 20 could enter the crank case 25 through the gap.

On the other hand, in the cylinder block 10 according to the present embodiment, since the cylinder liner 14 is provided with the engaging portion 26, an improved sealing effect is provided for a portion between the cylinder liner 14 and the cylinder block body 12 against entry of the coolant. Thus the coolant is prevented from entering into the crank case 25. A description will be given of the engaging portion 26*a* below.

Figure 4:
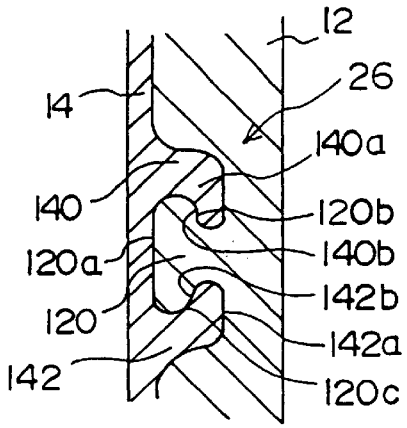
FIG. 4 is an enlarged cross-sectional view of an engaging portion provided to a cylinder liner of the first embodiment.

FIG. 4 is an enlarged cross-sectional view of the engaging portion 26 provided to the cylinder liner 14 according to the present embodiment, the engaging portion being cut in an axial direction of the cylinder liner 14. As shown in FIG. 4, the engaging portion 26 includes a pair of protrusions 140 and 142 which protrudes in a radially outward direction from an outer surface of the cylinder liner 14. The protrusions 140 and 142 have bent portions 140*a* and 142*a* at their ends, respectively, which are bent so that the bent portions 140*a* and 142*a* are opposite each other in the axial direction of the cylinder liner 14. As mentioned above, the cylinder block 10 is cast by poring molten metal into the cavity formed around the cylinder liner 14. Accordingly, the molten metal is filled in a space between the protrusions 140 and 142 of the engaging portion 26 of the cylinder liner 14, and an engaging protrusion 120 is formed on a surface of the cylinder block body 12 by the molten metal filled in the space between the protrusions 140 and 142. The engaging protrusion 120 has a top surface 120*a* and engaging surfaces 120*b* and 120*c*. The top surface 120*a* contacts a portion of the outer surface of the cylinder liner 14 between the protrusions 140 and 142. The engaging surfaces 120*b* and 120*c* engages the engaging surfaces 140*b* and 142*b* which are inner surfaces of the bent portions 140*a* and 142*a*.

According to the structure of the engaging portion 26, when a temperature of the cylinder block 10 is raised in association with an operation of the internal combustion engine, the outer diameter of the engaging surfaces 120*b* and 120*c* of the engaging protrusion 120 becomes greater than the inner diameter of the engaging surfaces 140*b* and 142*b* of the protrusions 140 and 142 since the cylinder block body 12 expands further than the cylinder liner 14. Accordingly, the engaging surfaces 120*b* and 120*c* and the engaging surfaces 140*b* and 142*b* press against each other and, thus, a sealing effect between the engaging surfaces 120*b* and 120*c* and the engaging surfaces 140*b* and 142*b* is improved. Thus, if the coolant from the water jacket 20 enters the interface between the cylinder block body 12 and the cylinder liner 14, the coolant is prevented from entering the crank case 25 since a tight seal is provided between the engaging surfaces 120*b* and 120*c* and the engaging surfaces 140*b* and 142*b*.

As mentioned above, in the present embodiment, the engaging protrusion 120 of the cylinder block body 12 engages the engaging portion 26 of the cylinder liner 14 so that the engaging protrusion 120 is positioned on the inner side of the engaging portion 26. Accordingly, when thermal expansion occurs in the cylinder block, a seal against the coolant is provided by the engaging portion 26. Thus, the coolant is prevented from intruding into the crank case 25.

It should be noted that, as shown in FIG. 2, in the cylinder block 10, the coolant 25 being prevented from entering the crank case 25 is ensured by providing the engaging portion 26 at two locations.

A description will now be given, with reference to FIGS. 5 to 13, of other embodiments of the present invention. It should be noted that those embodiments features a structure of an engaging portion provided on an outer surface of a cylinder liner, and parts other than the engaging portion have the same structure as that of the above-mentioned first embodiment.

Figure 5:
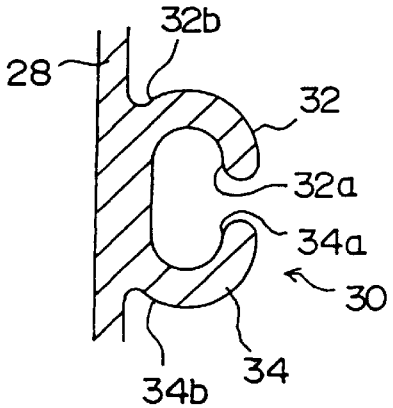
FIG. 5 is an enlarged cross-sectional view of an engaging portion provided to a cylinder liner of a second embodiment of the present invention.

FIG. 5 is an enlarged cross-sectional view of an engaging portion 28 formed on a cylinder liner 28 according to a second embodiment of the present invention, the engaging portion being cut in an axial direction of the cylinder liner 28. As shown in FIG. 5, the engaging portion 30 of the present embodiment includes a pair of protrusions 32 and 34 which protrudes radially outwardly from an outer surface of the cylinder liner 28. The protrusions 32 and 34 are formed in an arc-like shape so that the cross sections of the protrusions 32 and 34 are convex shapes extending in opposite directions to each other along the axis of the cylinder liner 28.

According to the structure of the engaging portion 30, similar to the engaging portion 26 of the first embodiment, a seal against the coolant is achieved by the cylinder liner 28 being engaged with the cylinder block body 12 from an outer side in a radial direction at inner surfaces 32*a* and 34*a* of ends of the protrusions 32 and 34 and outer surfaces 32*b* and 34*b* near the roots of the protrusions 32 and 34. In this case, a sealing effect at an interface between the cylinder block 12 and the cylinder liner 28 is improved by sealing engagement at two portions for each of the protrusions 32 and 34 when thermal expansion occurs in the cylinder block 10.

Figure 6:
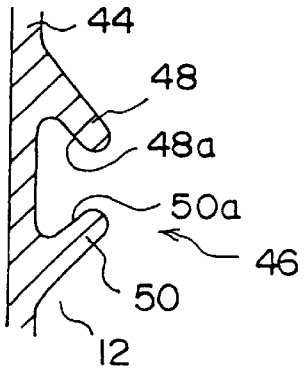
FIG. 6 is an enlarged cross-sectional view of an engaging portion provided to a cylinder liner of a third embodiment of the present invention.

FIG. 6 is an enlarged cross-sectional view of an engaging portion 46 formed on a cylinder liner 44 according to a third embodiment of the present invention, the engaging portion being cut in an axial direction of the cylinder liner 44. As shown in FIG. 6, the engaging portion 46 of the present embodiment includes a pair of protrusions 48 and 50 which protrudes radially outwardly from an outer surface of the cylinder liner 44. The protrusions 48 and 50 extend toward each other so that each of the protrusions provide a conical shape. According to the structure of the engaging portion 46, similar to the engaging portion 26 of the first embodiment, a seal effect against the coolant is achieved by the cylinder liner 44 being engaged with the cylinder block body 12 from an outer side in a radial direction at inner surfaces 48*a* and 50*a* of the protrusions 48 and 50.

It should be noted that as appreciated from the second and third embodiment, a sealing effect can be obtained even when a direction of engagement is inclined from a radial direction as long as a portion of the cylinder block body is present on an inner side of a portion of the cylinder liner.

Figure 7:
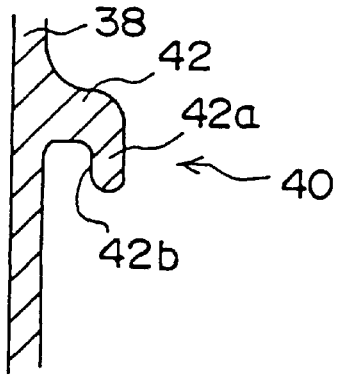
FIG. 7 is an enlarged cross-sectional view of an engaging portion provided to a cylinder liner of a fourth embodiment of the present invention.

FIG. 7 is an enlarged cross-sectional view of an engaging portion 40 formed on a cylinder liner 38 according to a fourth embodiment of the present invention. The engaging portion 40 of the present embodiment comprises a single protrusion 42 which has a construction similar to the protrusion 142 of the engaging portion 26 according to the above-mentioned first embodiment. In this structure, a sealing effect for an interface between the cylinder liner 38 and the cylinder block 12 against the coolant can be obtained when thermal expansion occurs in the cylinder block 10 since an inner surface 42*b* of a bent portion 42*a* engages the cylinder block body in a radial direction from the outer side. It should be noted that the protrusion 42 may have a structure similar to the protrusions 32 and 34 of the engaging portion 30 shown in FIG. 5 or the protrusions 48 and 50 of the engaging portion 46 shown in FIG. 6.

Figure 8:
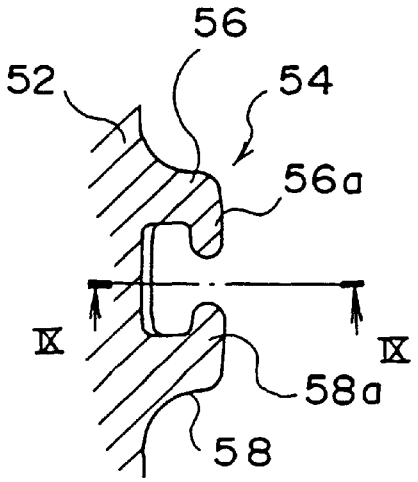
FIG. 8 is an enlarged cross-sectional view of an engaging portion provided to a cylinder liner of a fifth embodiment of the present invention.
Figure 9:
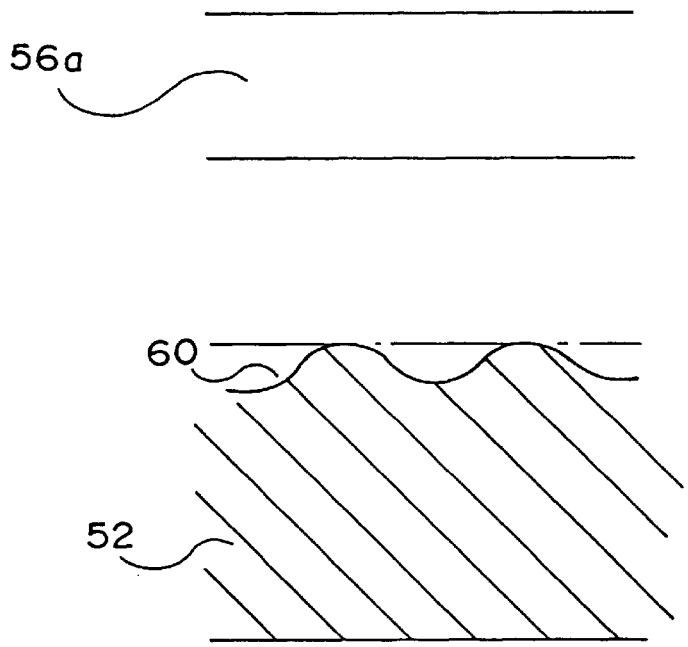
FIG. 9 is a cross-sectional view taken along a line IX—IX of FIG. 8.

FIG. 8 is an enlarged cross-sectional view of an engaging portion 54 formed on a cylinder liner 52 according to a fifth embodiment of the present invention, the engaging portion being cut in an axial direction of the cylinder liner 52. FIG. 9 is a cross-sectional view taken along a line IX of FIG. 8. As shown in FIG. 8, the engaging portion 54 of the present embodiment includes protrusions 56 and 58 which have a structure similar to the protrusions 140 and 142 shown in FIG. 4. In the present embodiment, similar to the first embodiment, a sealing effect can be obtained against entry of the coolant by inner surfaces of bent portions 56*a* and 58*a* provided on end portions of the protrusions 56 and 58. Additionally, as shown in FIG. 9, the engaging portion 54 according to the present embodiment includes an uneven portion 60 formed on an outer surface of the cylinder liner 52 between the protrusions 56 and 58, the uneven portion 60 extending in a circumferential direction of the cylinder liner 52.

As mentioned above, when the temperature of the cylinder block 10 is raised, a gap is formed between the cylinder liner 52 and the cylinder block body 12 since the cylinder block body 12 expands more than the cylinder liner 52 due to a difference in the thermal expansion coefficient of the cylinder liner 52 and the cylinder block body 12. In such a case, in the interface between the cylinder liner 52 and the cylinder block body 12, a relative displacement in a circumferential direction occurs as well as a relative displacement in a radial direction. Accordingly, if the relative displacement between the cylinder block body 12 and the cylinder liner 52 in the circumferential direction is prevented, the relative displacement in the radial direction can be prevented.

In the present embodiment, the cylinder liner 52 and the cylinder block body 12 engages each other in the circumferential direction by the uneven portion 60. Accordingly, the relative displacement between the cylinder liner 52 and the cylinder block body 12 in the circumferential direction is restricted, and thereby the relative displacement between the cylinder liner 52 and the cylinder block body 12 in the radial direction is also restricted. Thus, formation of a gap between the cylinder liner 52 and the cylinder block body 12 is prevented.

As mentioned above, according to the engaging portion 54 of the present embodiment, when a thermal expansion occurs in the cylinder block 10, a sealing effect against entry of the coolant is improved by a synergetic effect of the bent portions 56*a* and 58*a* of the protrusions 56 and 58 and the uneven portion 60. Thereby, the coolant is more positively prevented from entering the crank case.

It should be noted that, in the present embodiment, although the uneven portion 60 is provided between the protrusions 56 and 58, the present invention is not limited to this structure, that is, the uneven portion 60 may be provided by a portion of the outer surface of the cylinder liner 52 which portion is cast within the cylinder block body 12. That is, the uneven portion 60 may be provided a portion in which the cylinder liner 52 contacts the cylinder block body 12.

A description will now be given, with reference to FIGS. 10 and 11, of a sixth embodiment of the present invention. The sixth embodiment features an improvement of sealing characteristics against the coolant by increasing adhesion at a joining part between a cylinder liner 68 and the cylinder block body 12.

Figure 10:
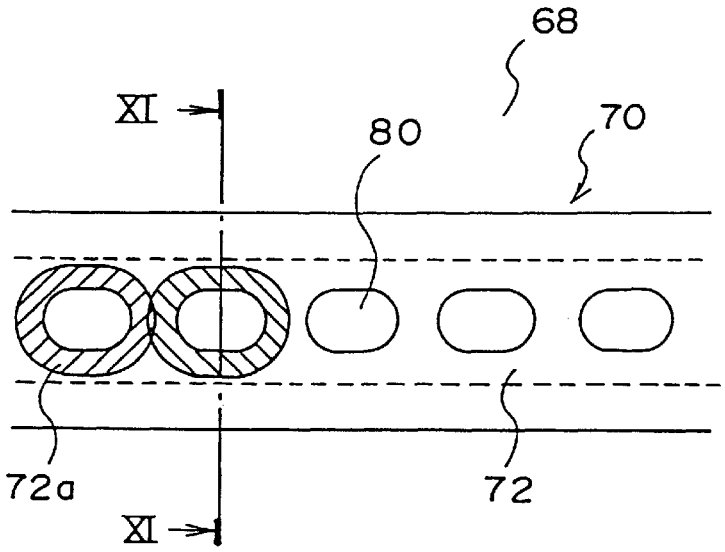
FIG. 10 is a view of an engaging portion provided to a cylinder liner according to a sixth embodiment, viewed from outside in a radial direction.

FIG. 10 is a view of an engaging portion 70 formed on the cylinder liner 68 viewed from a outside in a radial direction of the cylinder liner 68. FIG. 11 is a cross-sectional view taken along a line XI of FIG. 10. As shown in FIGS. 10 and 11, the engaging portion 70 includes an annular anchor portion 72 which is spaced apart from an outer surface of the cylinder liner 68 at a predetermined distance L in a radial direction of the cylinder liner 68. The anchor portion 72 is connected to the cylinder liner 68 by a rim portions 74 and 76 over the entire circumference of the cylinder liner 68 at its opposite ends in the axial direction of the cylinder liner 68. Accordingly, an annular space 78 having a thickness L in a radial direction is formed around the cylinder liner 68 by the anchor portion 72, the rim portions 74 and 76 and the outer surface of the cylinder liner 68. As shown in FIG. 10, a plurality of openings 80 are provided at equal intervals in a circumferential direction. It should be noted that the distance L, that is, the thickness L of the annular space 78 is set to a value greater than a thickness M of a portion 12*b* of the cylinder block body 12 which is located around the anchor portion 72.

According to the structure of the anchor portion 70, when molten the cylinder block 10 is cast, the molten metal poured in a cavity fills the annular space 78 through the openings 80. In a process for cooling and solidification after the molten metal is poured, the molten metal shrinks so that a center plane of the thickness of the cylinder block body 12 moves radially inwardly and the thickness is reduced. In this case, as mentioned above, since the thickness L of the annular space 78 is greater than the thickness M of the portion 12*b* of the cylinder block body 12, the center plane of the thickness in a portion constituted by the molten metal in the annular space 78, the opening 80 and the portion 12*b* of the cylinder block body 12 is shifted toward the annular space 78. Accordingly, in this portion, a flow is generated in the molten metal from the portion 12*b* of the cylinder block body 12 to the annular space 78. Due to the flow of the molten metal, adhesion between the anchor portion 72 and the cylinder block body 12 is improved in an area (a hatched area 72*a* in FIG. 10) near the openings 80 of the anchor portion 72. Thus, in the present embodiment, a sealing effect against the coolant at the interface between the cylinder block body 12 and the cylinder liner 68 is improved by improving the adhesion between the anchor portion 72 and the portion 12*b* in the process for cooling and solidification. Thereby, the coolant is prevented from intruding into the crank case.

It should be noted that, in the present embodiment, similar to the first to fifth embodiments, a seal against the coolant at the interface between the cylinder liner 68 and the cylinder block body 12 is also provided by a inner surface of the anchor portion 72 being engaged with a portion of the cylinder block body 12 within the annular space 78 in a radial direction from an outer side.

A description will now be given, with reference to FIG. 12, of a seventh embodiment of the present invention. FIG.

12 is a cross-sectional view of an engaging portion 100 formed on a cylinder liner 98 according to the present embodiment. As shown in FIG. 12, the engaging portion 100 comprises a rib 102 and an anchor portion 104. The rib 102 extends radially outwardly from an outer surface of the cylinder liner 98. The anchor portion 104 has an annular shape and is apart from the outer surface of the cylinder liner 98 by a distance H. The anchor portion 104 is provided with openings 108 and 110 formed at equal intervals in a circumferential direction. The distance H is set to a value greater than a thickness K of a portion 12*c* around the anchor portion 104 of the cylinder block body 12.

According to the above-mentioned structure, similar to the engaging portion 80 of the sixth embodiment, a flow of the molten metal is generated from an outer side to an inner side of the anchor portion 104 via the openings 108 and 110 in the process for cooling and solidification. Thus, adhesion between the anchor portion 104 and the portion 12*c* is improved at portions of the outer surface of the anchor portion 104 around the openings 108 and 110 and, thereby, a seal against the coolant can be provided.

Figure 13:
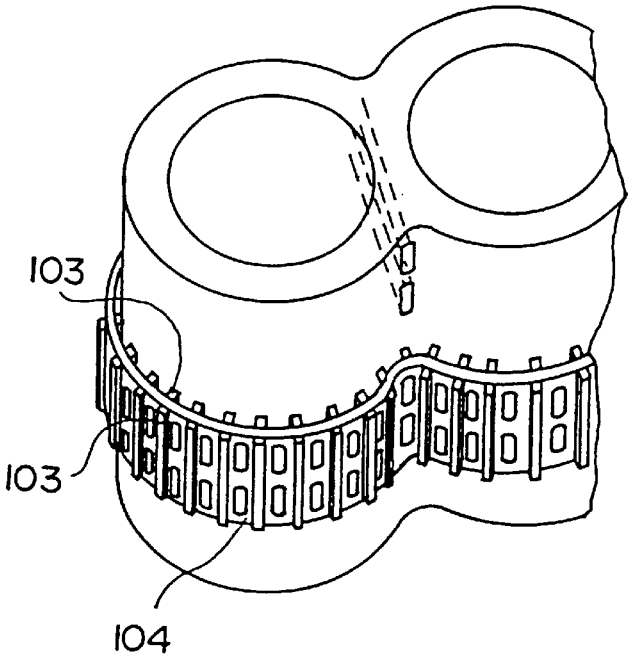
FIG. 13 is an perspective view of an engaging portion provided to a cylinder liner of an eighth embodiment of the present invention.

It should be noted that, in the present embodiment, although the anchor portion 104 is supported by the rib 102 circumferentially extending on the cylinder liner 98, the anchor portion may be supported by a plurality of ribs 103 arranged at a predetermined interval in a circumferential direction, each of which extends in a radial direction of the cylinder liner 98 as shown in a perspective view of FIG. 13.

It should be noted that, in the sixth and seventh embodiments, the anchor portions 72 and 104 corresponds to an engaging arrangement.

A description will now be given, with reference to FIGS. 14 to 34, of an example of a manufacturing method for the cylinder block according to the first embodiment of the present invention. The manufacturing method features, especially, a formation of a configuration having a space located at an interior of the cylinder liner like the engaging portion 26 of the cylinder liner 14.

Figure 14:
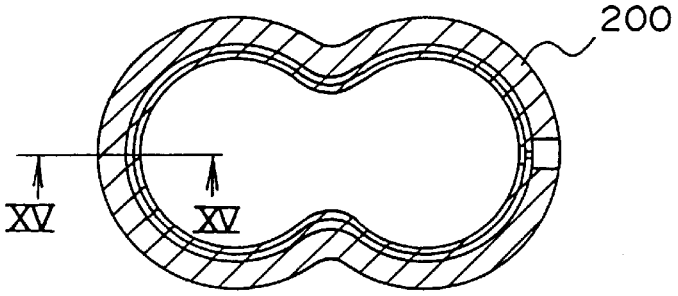
FIG. 14 is a plan vie of a core used for manufacturing a cylinder block according to the first embodiment of the present invention.
Figure 15:
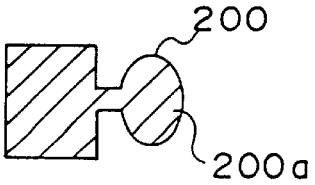
FIG. 15 is a cross-sectional view of the core.
Figure 16:
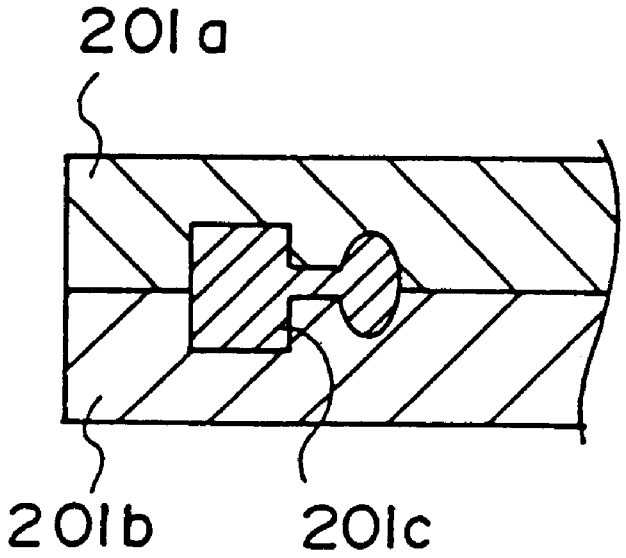
FIG. 16 is a cross-sectional view for explaining a manufacturing method of the core.

FIG. 14 is a plan view of a core 200 for forming the engaging portion on the cylinder liner 14. FIG. 15 is a cross-sectional view taken along a line XV—XV of FIG. 14. As shown in FIG. 14, the core 200 is a sand mold corresponding to a double cylinder structure. As shown in FIG. 15, the core 200 has a portion 200*a* formed on an inner circumferential surface thereof so as to form the engaging portion 26 of the cylinder liner 14. FIG. 16 is a cross-sectional view for explaining a manufacturing method of the core 200. As shown in FIG. 16, the core 200 can be manufactured by filling a molding material into a cavity 201*c* formed by a combination of a mold 201*a* and a mold 201*b*. It should be noted that the core 200 can be formed with a cross section having an arbitrary configuration by changing the shapes of the molds 201*a* and 201*b*.

Figure 17:
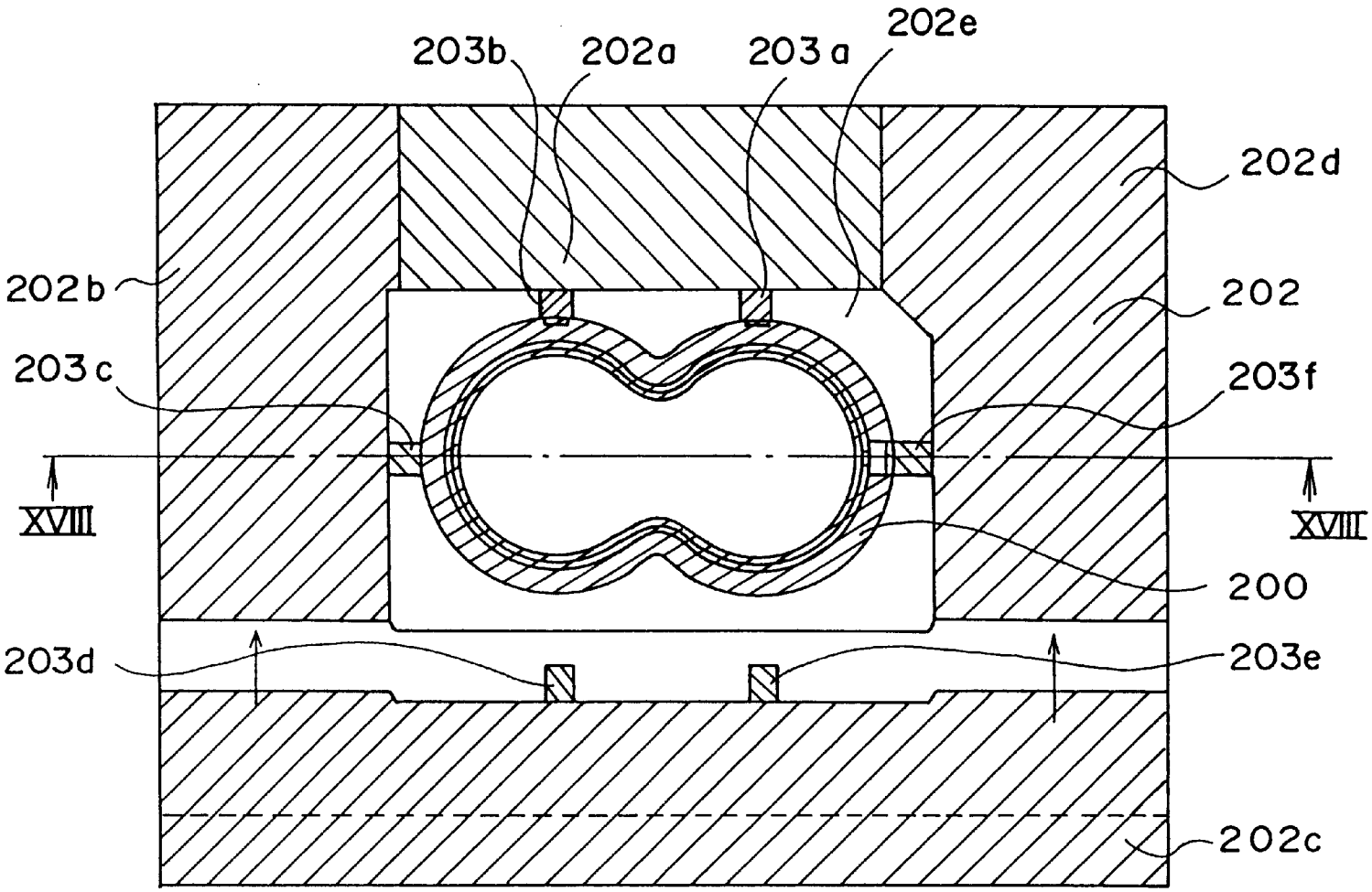
FIG. 17 is a plane view of a mold for manufacturing the cylinder block according to the first embodiment of the present invention in a state where the core is placed in a predetermined position.
Figure 18:
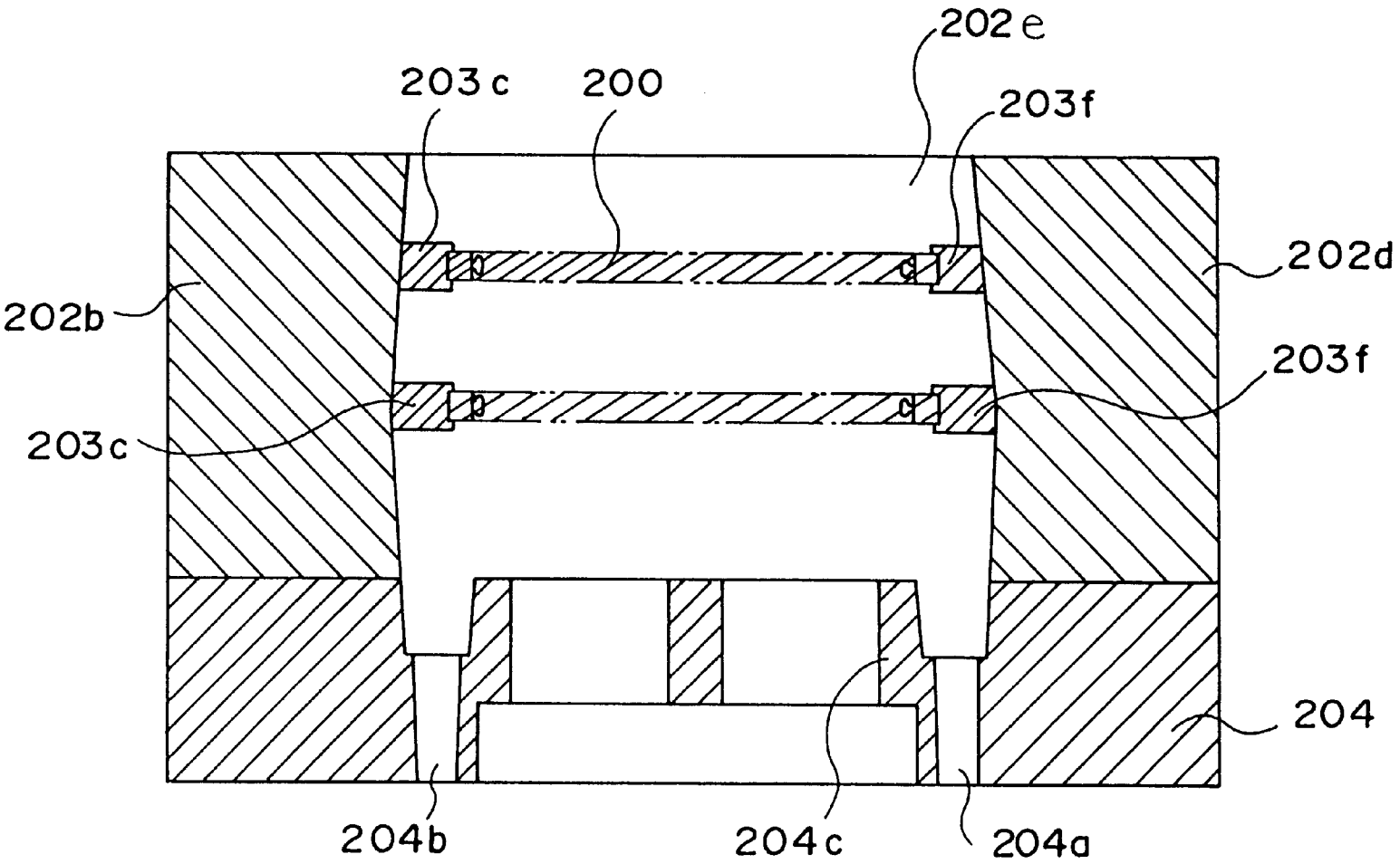
FIG. 18 is a cross-sectional view taken along a line XVIII—XVIII of FIG. 17.

The core 200 is placed inside a main mold 202. FIG. 17 is a plan view of the main mold 202 in which the core 200 is placed. FIG. 18 is a cross-sectional view taken along a line XVIII—XVIII of FIG. 17. The main mold 202 is constituted by a combination of four molds 202*a*, 202*b*, 202*c* and 202*d*. A cavity 202*e* is formed inside the molds 202*a*, 202*b*, 202*c* and 202*d* when they are combined. Additionally, the main mold 202 is provided with protrusions 203*a* to 203*f* (only protrusions 203*c* and 203*f* are shown in the figure) arranged in two different levels. An end of each of the protrusions 203*a* to 203*f* engages an outer surface of the corresponding core 200. The cores 200 are held in predetermined positions by the protrusions 203*a* to 203*f* as shown in FIGS. 17 and 18.

As shown in FIG. 18, the main body 202 is placed on a top surface of a molding die 204. The molding die 204 has blow ports 204*a* and 204*b* which connects the cavity 202*e* to a bottom surface 204 of the molding die 204. Additionally, the molding die 204 has a liner pattern table 204*c* on which a liner pattern 206 (described later is seated.

Figure 19:
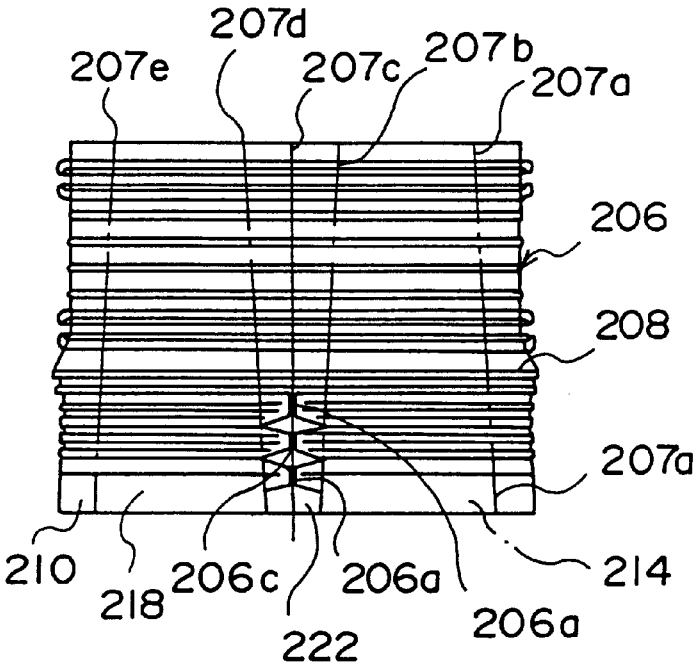
FIG. 19 is a front view of a liner pattern.
Figure 20:
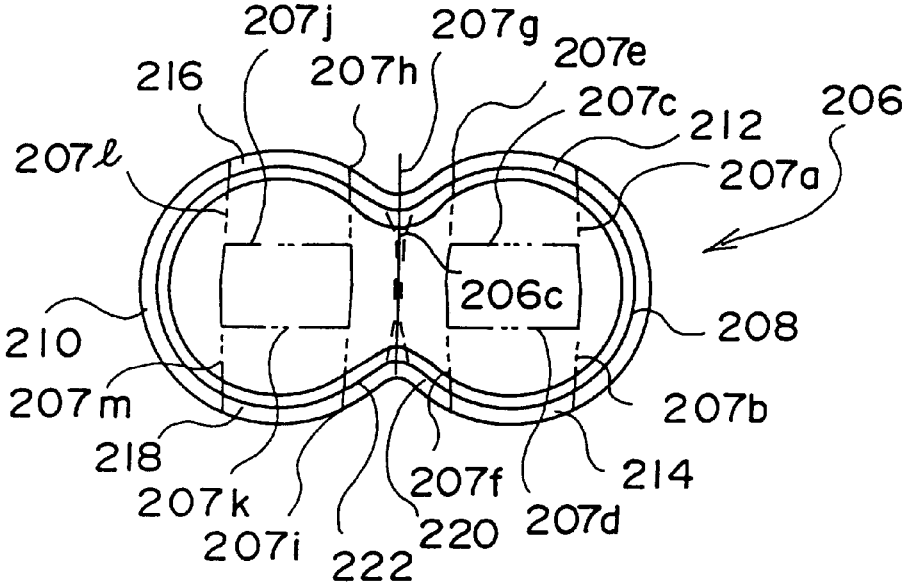
FIG. 20 is a plan view of the liner pattern.
Figure 21:
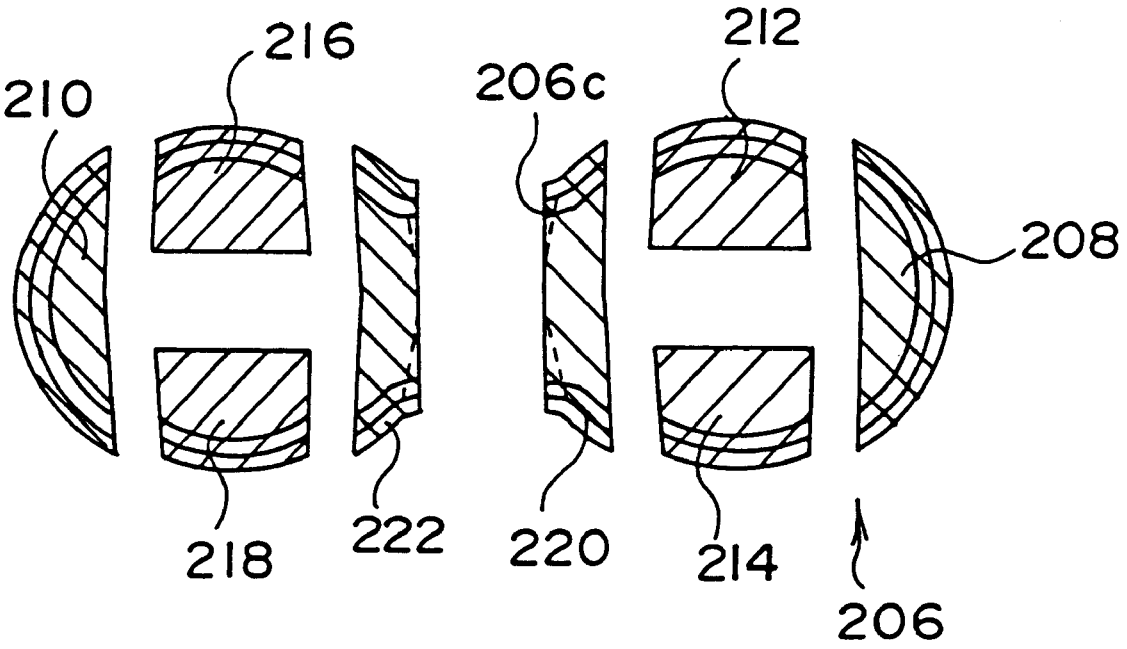
FIG. 21 is a plan view of the liner pattern which is divided into pieces.
Figure 22:
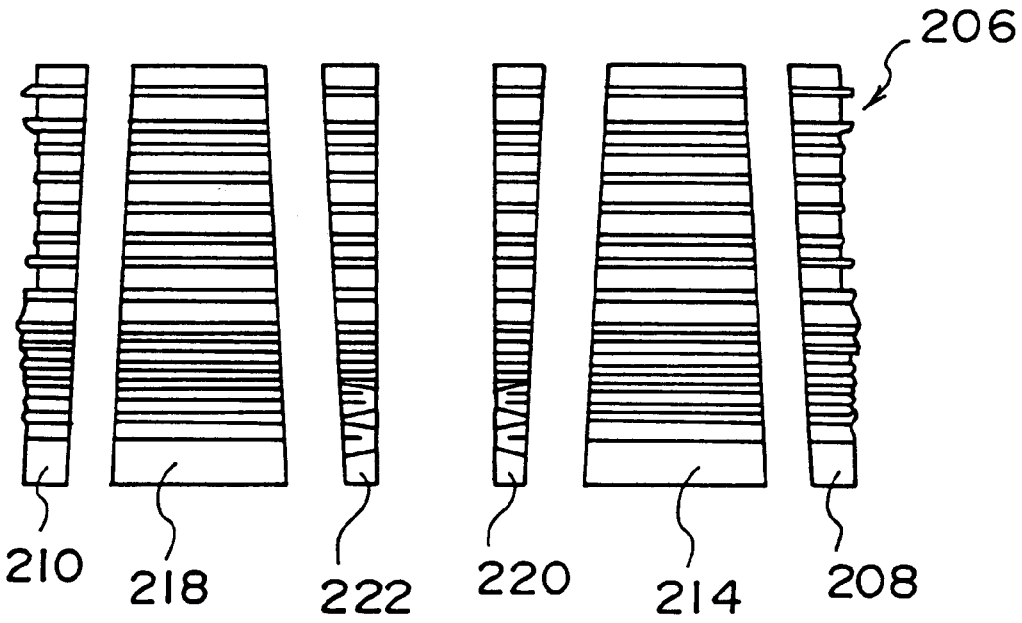
FIG. 22 is a front view of the liner pattern which is divided into pieces.

After the cores 200 are placed, the liner pattern 206 is positioned inside the cores 200. FIG. 19 is a front view of the liner pattern 206. FIG. 20 is a plan view of the liner pattern 206. The liner pattern 206 is a hollow metal mold having a closed top end and an open bottom end. As shown in FIGS. 19 and 20, the liner pattern 206 has a plurality of water passage holes 206*a* to 206*c* so as to form the inter-bore water passages 14*c* to 14*e* (refer to FIG. 3). The liner pattern 206 is divided in to the outer pieces 208 and 210, middle pieces 212, 214, 216 and 218 and inter-bore pieces 220 and 222 by dividing lines 207*a* to 207*m*. FIGS. 21 and 22 show a state where the liner 206 is divided into the pieces 208 to 222.

Figure 23:
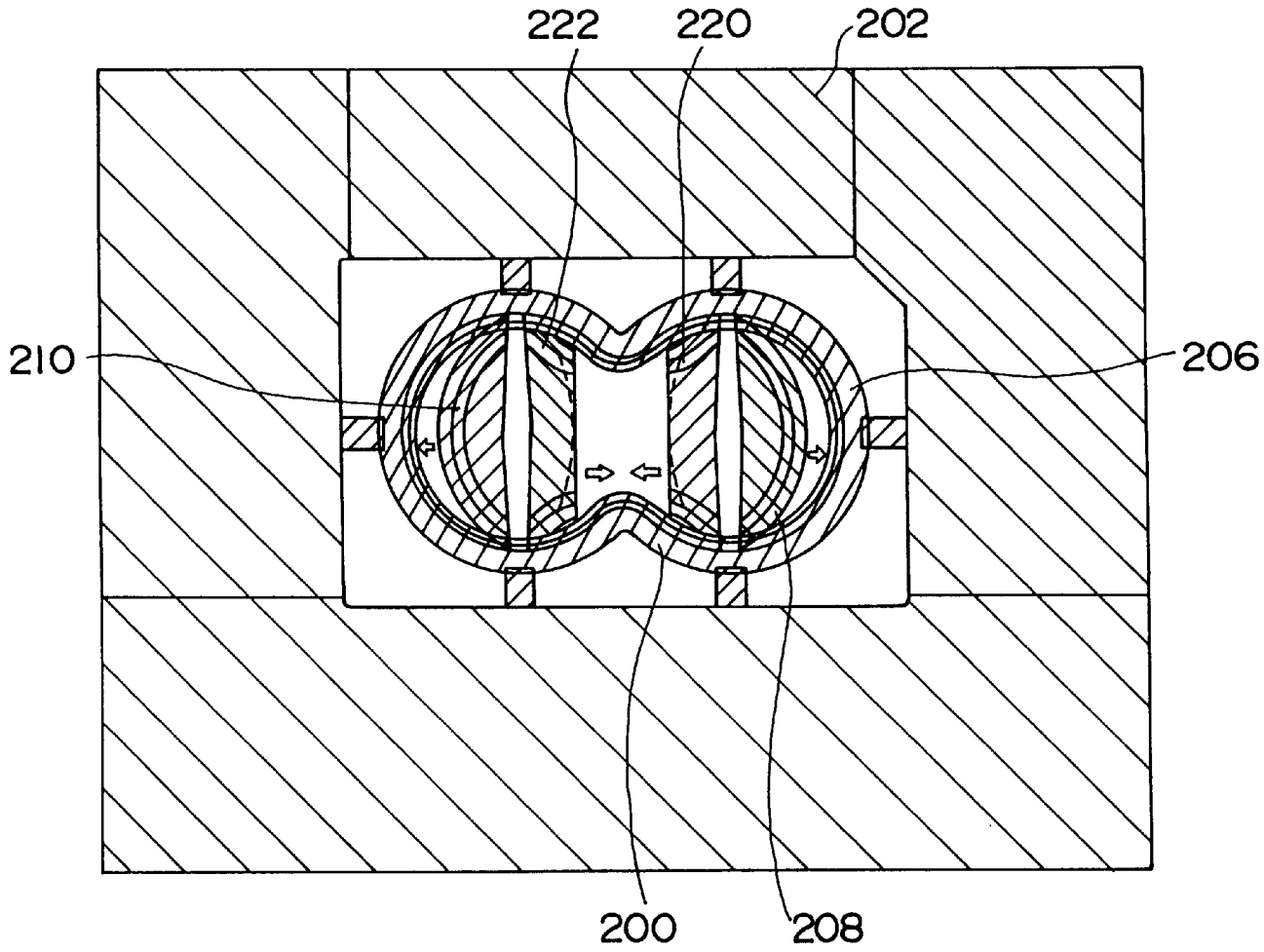
FIG. 23 is a view of the liner pattern located in the mold for explaining die matching of the liner pattern inside the core.
Figure 24:
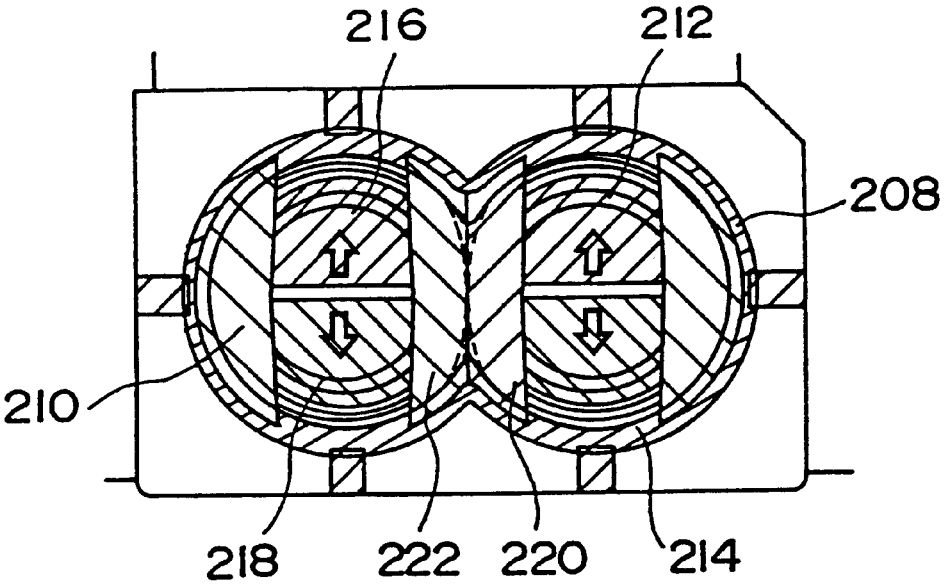
FIG. 24 is a view of the liner pattern located in the mold for explaining die matching of the liner pattern inside the core.
Figure 25:
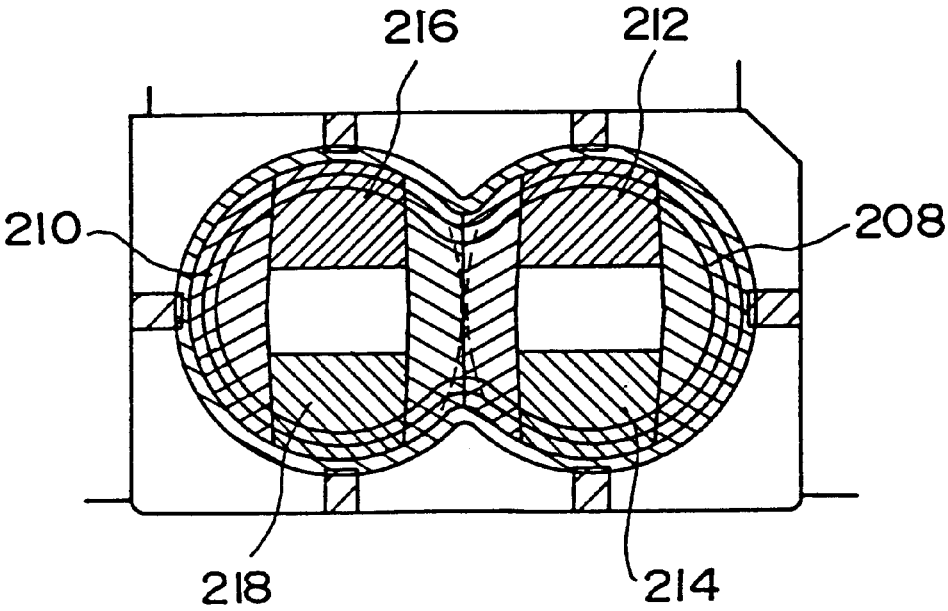
FIG. 25 is a view of the liner pattern located in the mold in a state where the liner pattern is die matched in a predetermined position inside the core.

FIGS. 23 to 25 are views for explaining a method for die matching the liner pattern 206 inside the core 200. When the loner pattern 206 is die matched with the core 200, the outer pieces 208 and 210 and the inter-bore pieces 220 and 222 are inserted into inside the cores 200 as shown in FIG. 23. Thereafter, each piece is moved in directions as indicated by arrows in FIG. 23 so as to die match each piece in a predetermined position with respect to the cores 200. Then, as shown in FIG. 24, the middle pieces 212 to 218 are placed between the outer pieces 208 and 210 and the inter-bore pieces 220 and 222, respectively. Thereafter, the middle pieces 212 to 218 are moved in directions indicated by arrows in FIG. 24. Thereby, the middle pieces 212 to 218 are die matched in predetermined positions as shown in FIG. 25. It should be noted that the liner pattern table 204*b* of the molding die 204 is arranged so that the pieces 208 to 222 are placed in predetermined positions along the axial direction in a state where the pieces constituting the liner pattern 206 are placed on the liner pattern table 204*b*. Thereby, die matching of the liner pattern can be easily performed.

Figure 26:
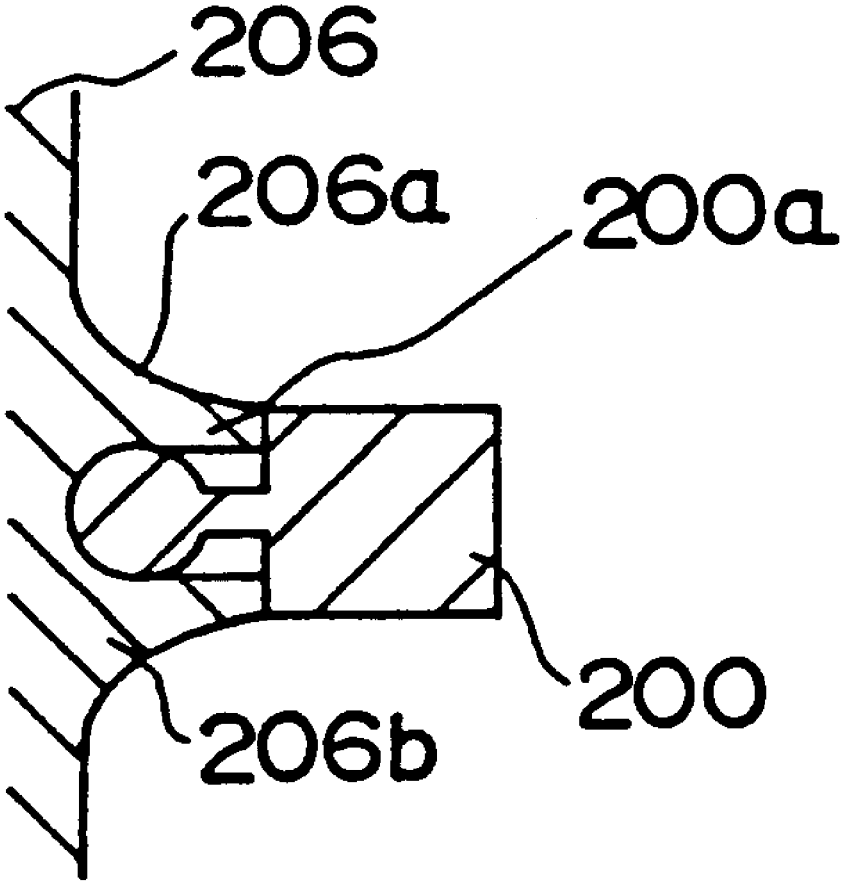
FIG. 26 is an enlarged cross-sectional view of an engaging portion between an inner surface of the core and the liner pattern.

FIG. 26 is a cross-sectional view of a portion where the core 200 engages the liner pattern 206, the portion being cut along the axial direction of the liner pattern 206. As shown in FIG. 26, a pair of protrusions 206*a* and 206*b* are formed on an outer surface of the liner pattern 206, the protrusions engaging the portion 200*a* of the core 200. The position of the protrusions 206*a* and 206*b* correspond to the engaging portion 26 of the liner 14. The core 200 and the liner pattern 206 engage with each other so that the portion 200*a* of the core 200 is placed within a space defined by the protrusions 206*a* and 206*b*. According to this structure, when the mold material is filled around the liner pattern 206 and the mold material and the core 200 becomes a solid piece, the mold material does not enter the above-mentioned space. Thus, a portion of the sand mold which forms an outer surface of the engaging portion 26 is formed by an upper surface of the protrusion 206*a* and a lower surface of the protrusion 206*b* in FIG. 26, and a portion of the sand mold which forms an inner surface of the engaging portion 26 is formed by the portion 200*a* of the core 200.

Figure 27:
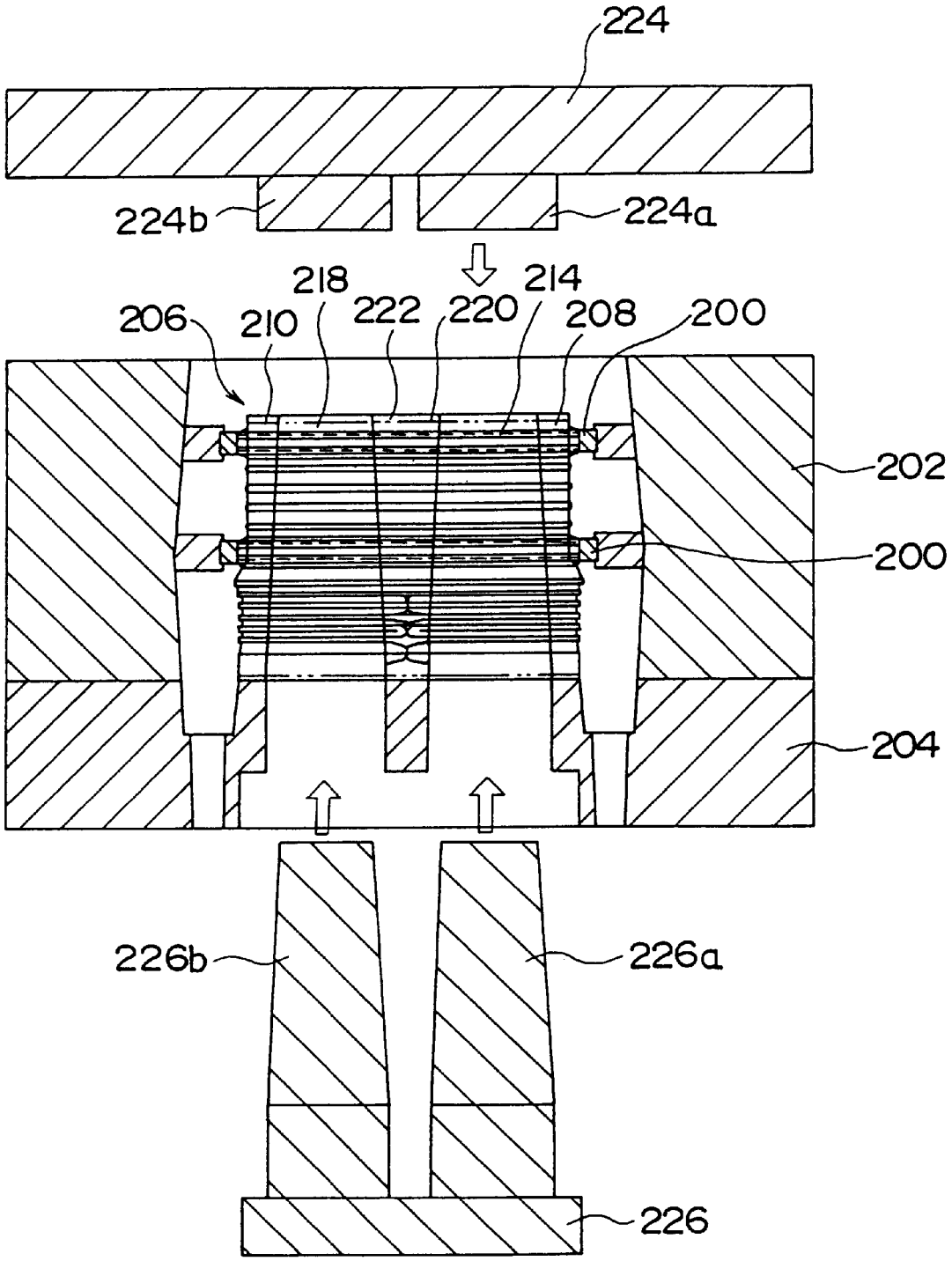
FIG. 27 is a view for explaining a procedure for die matching an upper mold and a lower mold.
Figure 28:
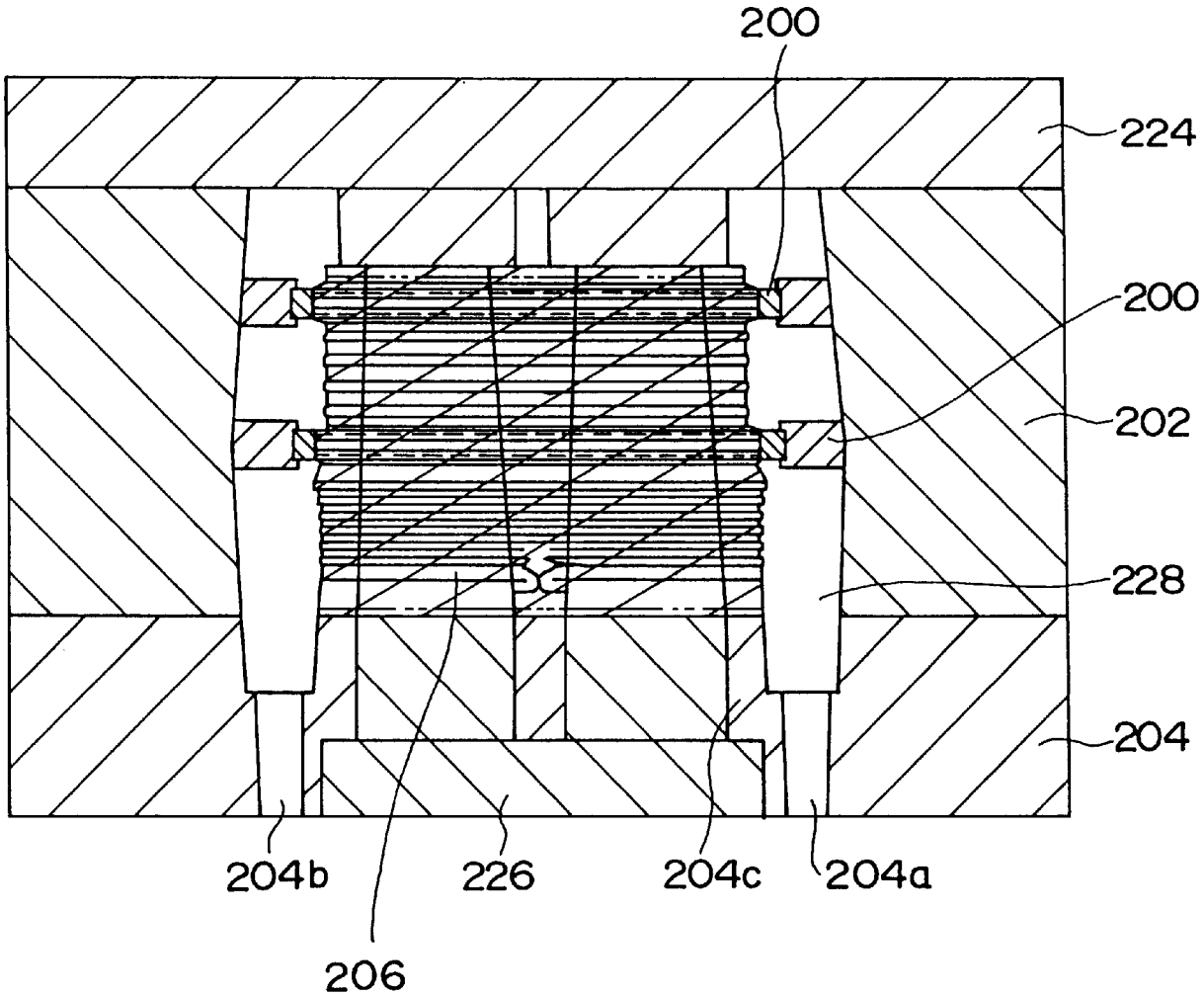
FIG. 28 is a view of the upper mold and the lower mold which are die matched in predetermined positions.

After the die matching of the liner pattern 206 is completed, an upper die 224 and a lower die 226 are die matched from the upper side and the lower side of the liner pattern 206 as shown in FIG. 27. The lower die 226 is provided with two cylindrical portions 226*a* and 226*b* which are inserted inside the liner pattern 206 by passing through openings provided in the liner pattern table 204*c* of the liner pattern 204. Additionally, the upper die 224 is provided with table portions 224*a* and 224*b* which engage the top surface of the liner pattern 206. FIG. 28 shows a state where the upper die 224 and the lower die 226 are die matched in predetermined positions. As shown in FIG. 28, the liner pattern 206 is held in a predetermined position by the upper die 224 and the lower die 226 being die matched. In this state, a cavity 228 is formed between an inner surface of the main mold 202 and the outer surface of the liner pattern 206.

Figure 29:
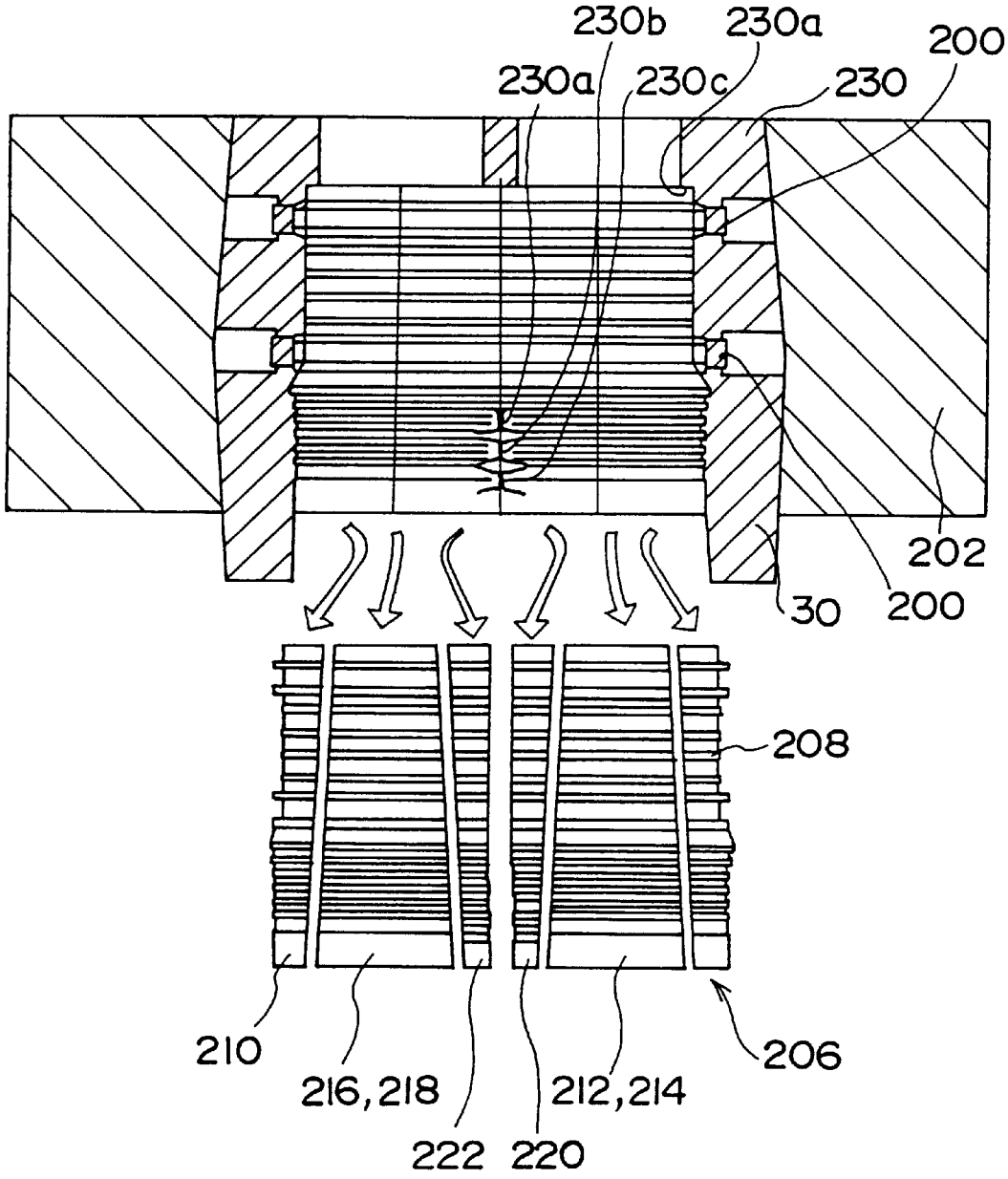
FIG. 29 is a view of the mold in a state where the liner pattern is removed after an outer mold pattern was formed.

After the die matching of the upper die 224 and the lower die 226 is completed, the mold material is introduced into the cavity 228 through the blow ports 204*a* and 204*b*. Then, catalytic gas is passed through the mold material filled in the cavity 228 so as to solidify the mold material, and the solidified material and the cores 200 are formed into one piece. After the upper die 224 and the lower die 226 are removed, the middle pieces 212 to 218 are pulled out first, and then the outer pieces 208 and 210 and the inter-bore pieces 220 and 222 are gathered toward the center of the corresponding cylinder and pulled out as shown in FIG. 29. In this state, an outer mold pattern 230 is formed in which the mold material filled in the cavity 228 and the cores 200 are combined into one piece. It should be noted that an engaging step 230*a* is formed on an inner surface of the outer mold pattern 230 by an upper peripheral corner of the liner pattern 206. Additionally, water passage forming portions 230*a* to 230*c* are formed by the mold material filled in the water passage holes 206*a* to 206*c* of the liner pattern 206.

Figure 30:
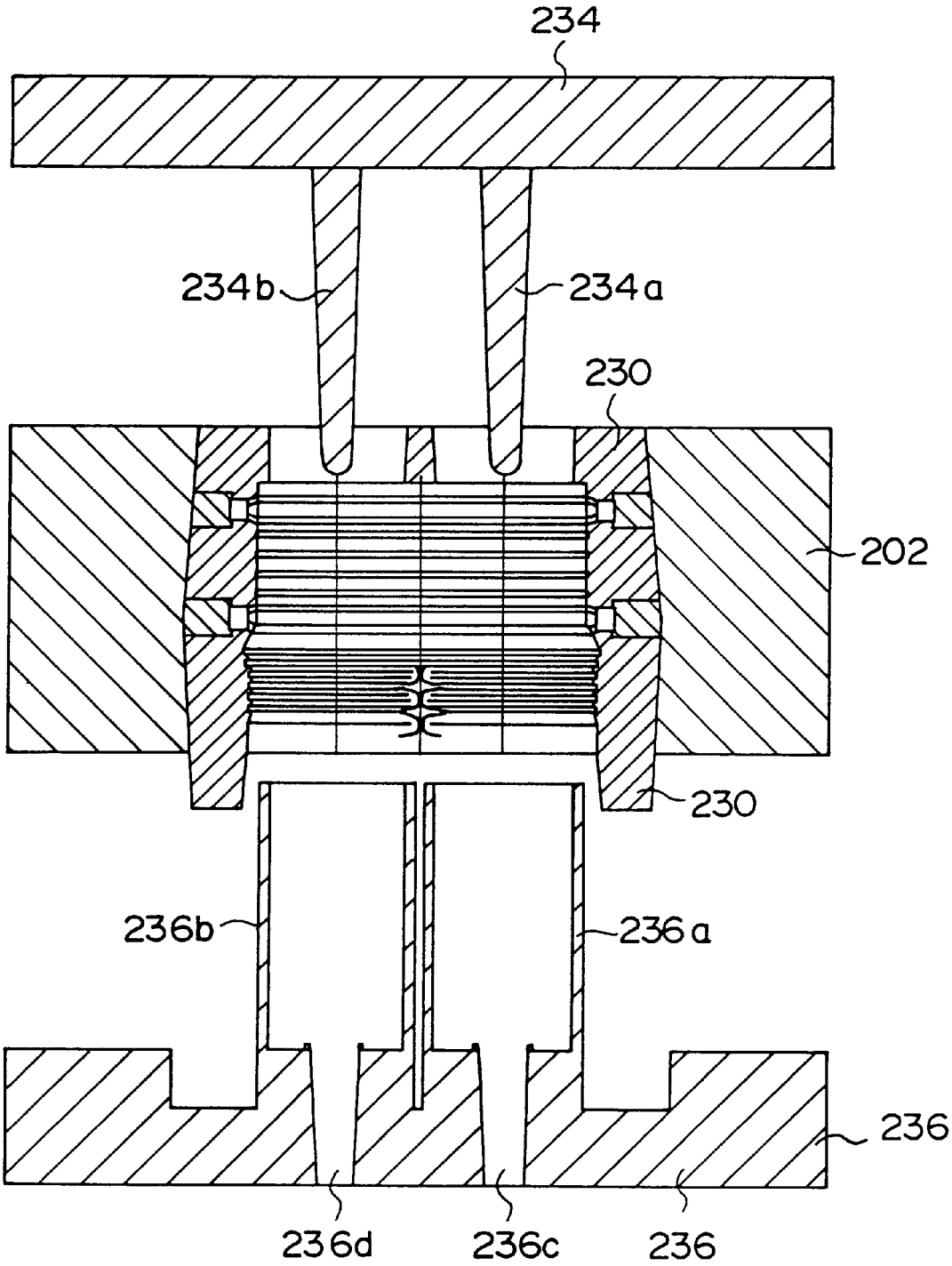
FIG. 30 is a cross-sectional view for explaining a procedure of die matching a bore die and an inner die.
Figure 31:
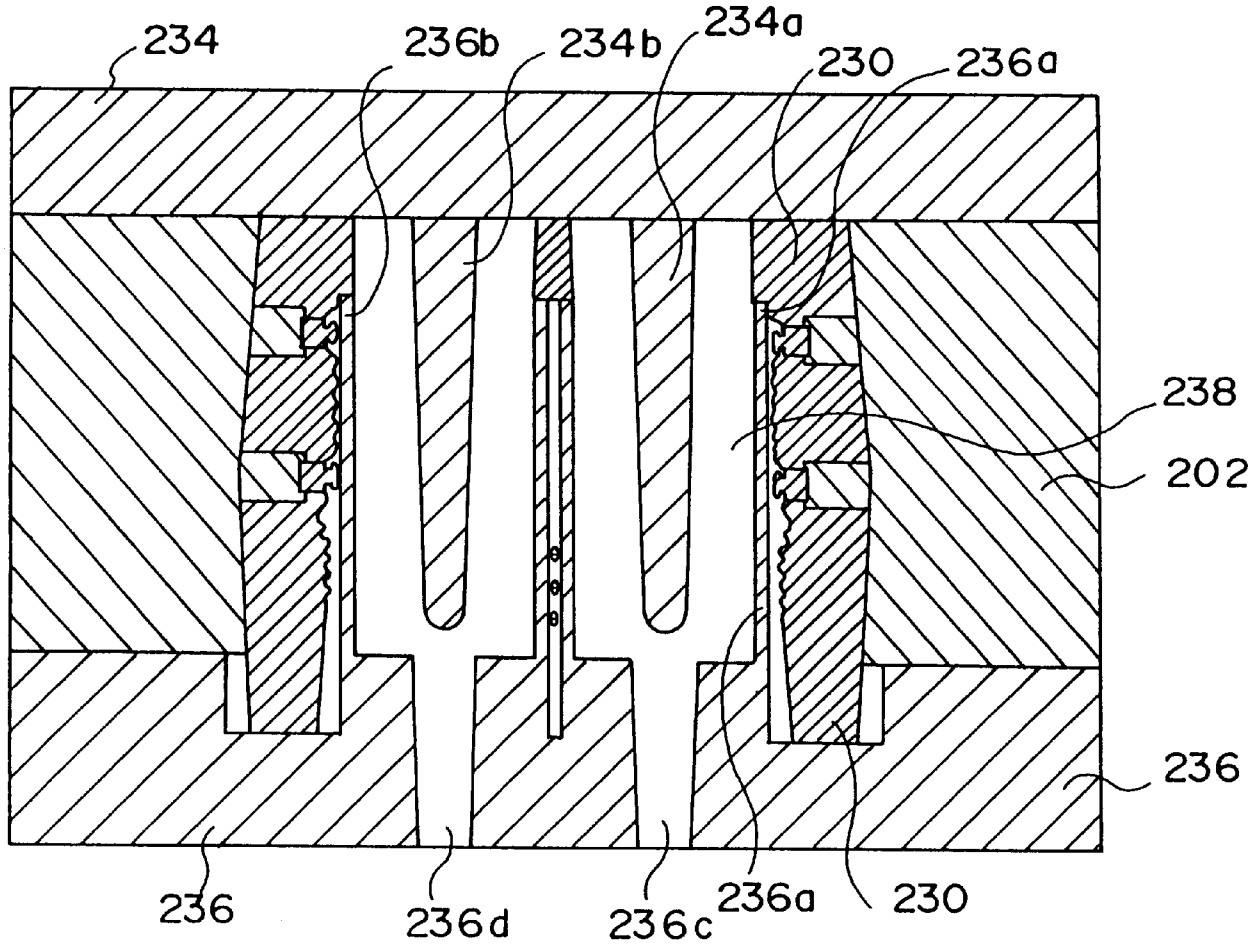
FIG. 31 is a cross-sectional view of the bore die and the inner die which are die matched.
Figure 32:
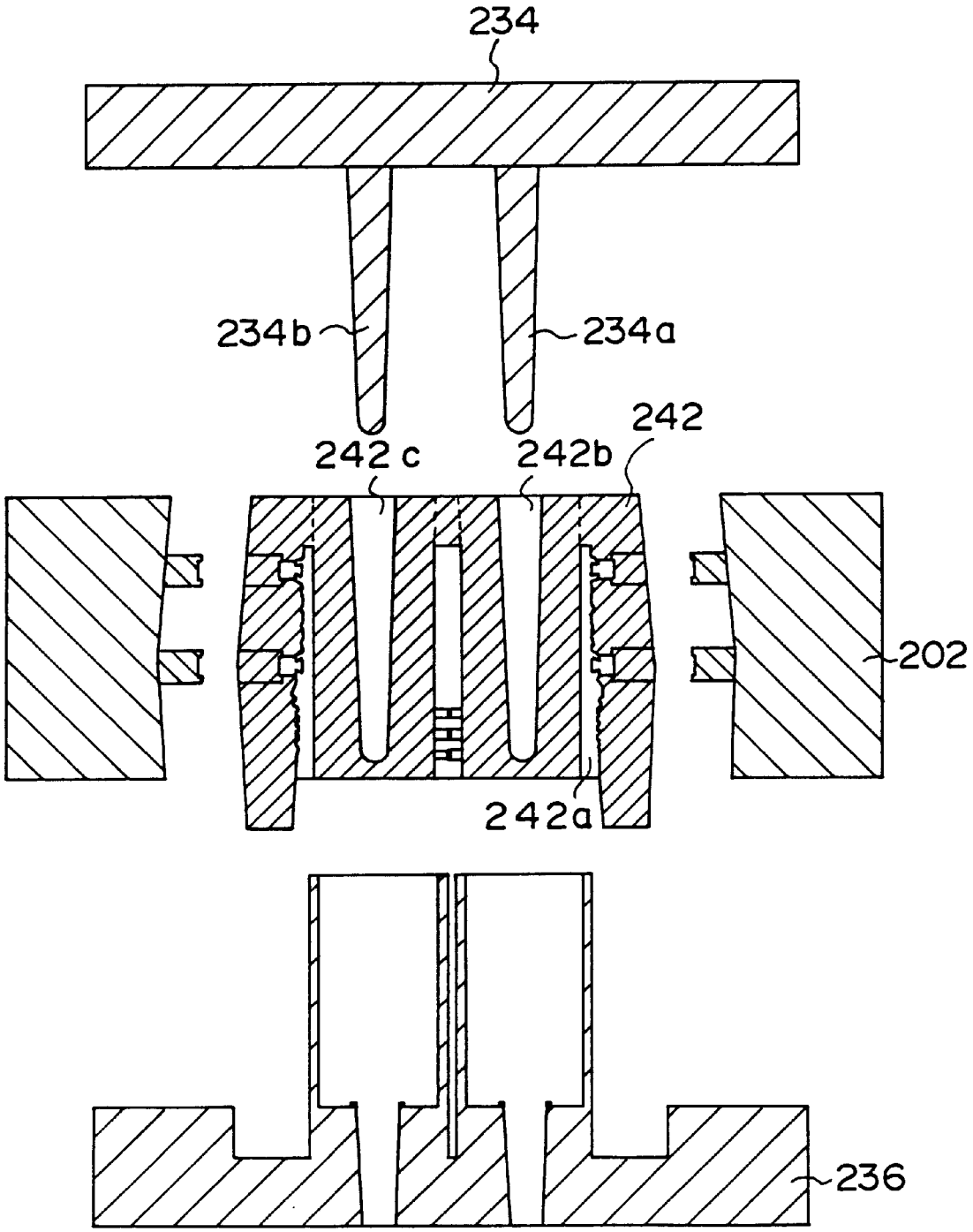
FIG. 32 is a cross-sectional view of the liner mold pattern after it is molded.

After the outer mold pattern 230 is formed which forms the outer surface of the cylinder liner 14, another mold pattern is formed which forms the inner surface, that is, the cylinder bore of the cylinder liner 14. First, as shown in FIG. 30, an inner die 234 and a bore die 236 are die matched from the upper side and the lower side of the outer mold pattern 230. FIG. 32 shows a state where the inner die 234 and the bore die 236 are die matched. As shown in FIG. 3 and 31, the inner die 234 is provided with cylindrical portions 234*a* and 234*b* which protrude into inside the outer mold pattern 230 when it is die matched. The bore die 236 is provided with inner mold patterns 236*a* and 236*b* having a configuration the same as that of each of the cylinder bore surfaces. The inner mold patterns 236*a* and 236*b* extend upwardly so that each of the inner mold patterns 236*a* and 236*b* faces an inner surface of the corresponding inner surface of the outer mold pattern 230 when the bore die 236 is die matched. An end of each of the inner mold patterns 236*a* and 236*b* engages the engaging step 230*a* when the bore die is die matched. Further, the bore die 236 is provided with blow ports 236*c* and 236*d* which connect a space formed under a bottom surface of the bore die 236 to spaces formed inside the inner mold patterns 236*a* and 236*b*.

A mold material is introduced into cavities 238 formed inside the inner mold patterns 236*a* and 236*b* of the bore die 236 through the blow ports 236*c* and 236*d*. In this case, upper ends of the inner mold patterns 236*a* and 236*b* of the bore die 236 engage the engaging step 230*a* of the outer mold pattern 230. Thereby, the mold material is prevented from entering a space formed between outer surfaces of the inner mold patterns 236*a* and 236*b* and the outer mold pattern 230. The mold material filled in the cavity 238 is solidified by a catalytic gas being passed therethrough. The solidified mold material is unitized with the outer mold pattern at a portion above the engaging step 230. Then, as shown in FIG. 32, the upper die 234 and the lower die (bore die) 236 are removed upwardly and downwardly, respectively, and the parts of the main mold 202 are moved in side directions. Thus, a liner mold pattern 242 is taken out in which the mold material filled in the cavity 238 and the outer mold pattern 230 are unitized. In the liner mold pattern 242, a liner forming cavity 242*a* is formed by a space occupied by the inner mold patterns 236*a* and 236*b* of the bore die 236 and a space between the inner mold patters 236*a* and 236*b* and the outer mold pattern 230. Additionally, hollow portions 242*b* and 242*c* are formed which correspond to the cylindrical portions 242*b* and 242*c*, respectively. The hollow portions 242*b* and 242*c* are provided for discharging a gas included in the molten metal of the liner mold pattern 242.

Figure 33:
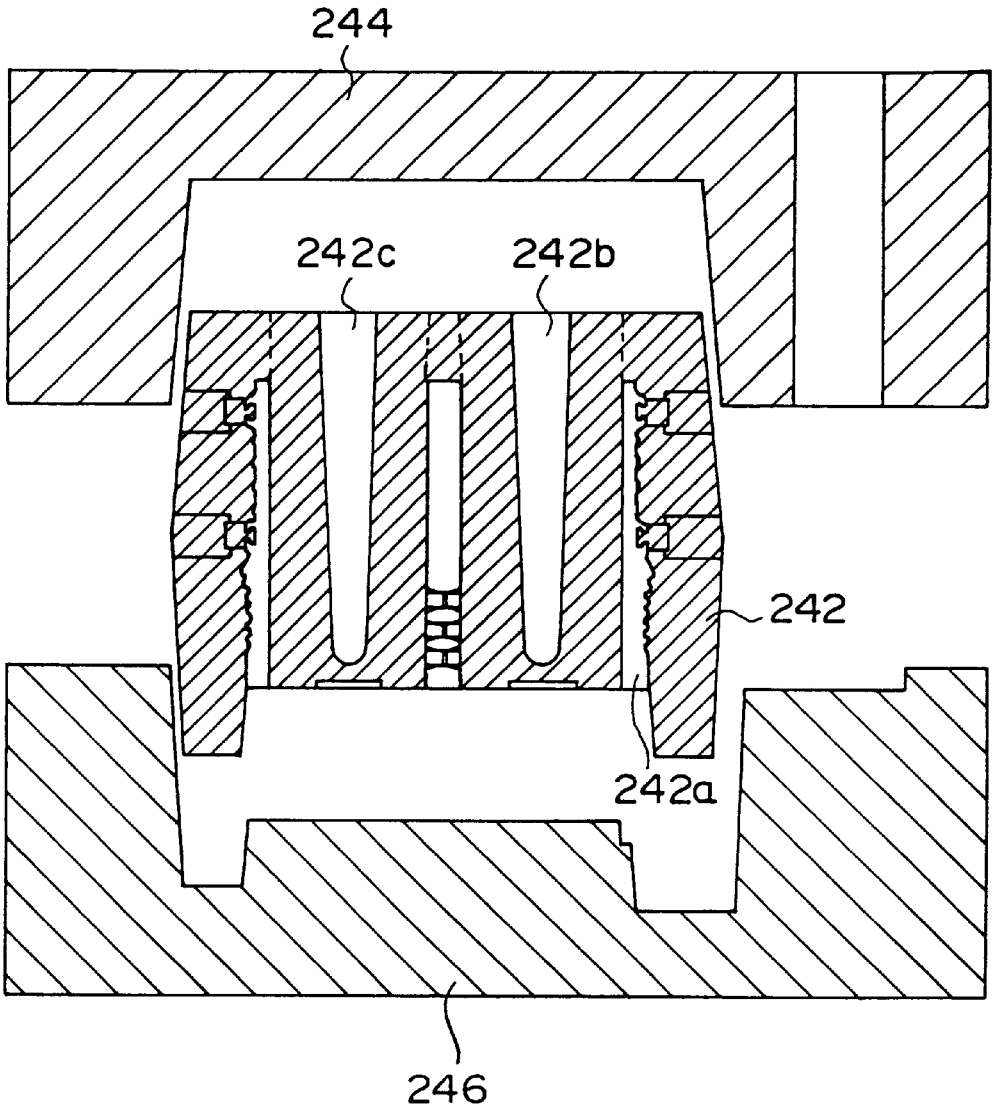
FIG. 33 is a view for explaining a procedure of die matching the liner mold pattern in a mold.
Figure 34:
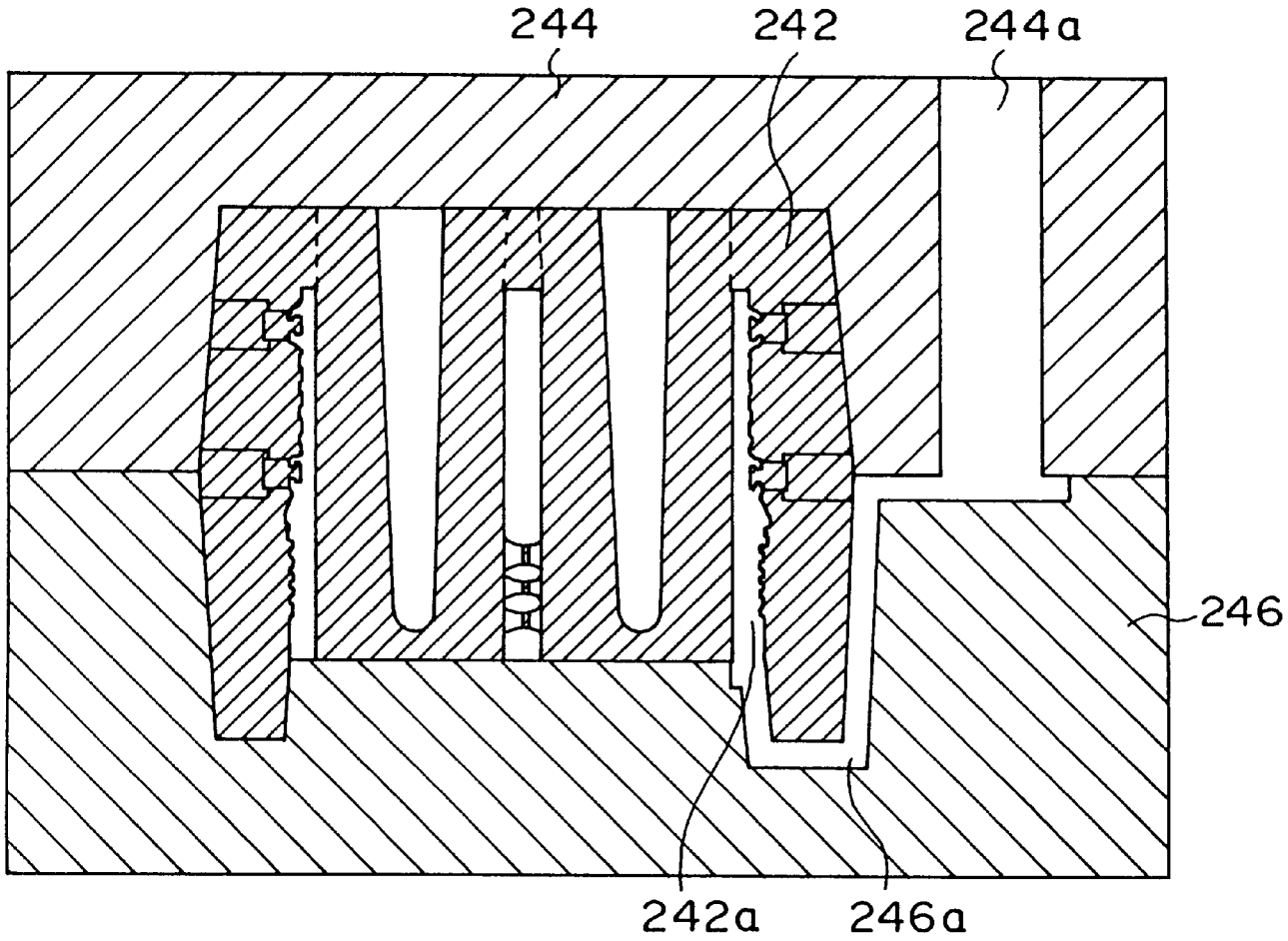
FIG. 34 is a cross-sectional view of the liner pattern die matched in the mold.

After the liner mold pattern 242 is formed which is a pattern for forming the cylinder liner 14, a liner casting upper mold 244 and a liner casting lower mold 246 are die matched to the liner mold pattern 242 from the upper side and the lower side 242, respectively, as shown in FIG. 33. FIG. 34 shows a state in which the liner casting upper mold 244 and the liner casting lower mold 246 are die matched. As shown in FIG. 34, the liner casting upper mold 244 is provided with a gate 244*a*. The liner casting lower mold 246 is constructed so that a runner 246*a* is formed when it is die matched, the runner 246 connecting the gate 244*a* to the liner forming portion 242*a*.

After the die matching of the liner casting upper mold 244 and the liner casting lower mold 246 is completed, the molten cast iron is introduced into the forming portion 242*a* of the liner mold pattern 242 from the gate 244*a* of the liner casting upper mold 244 so as to cast the cylinder liner 14.

Thereafter, a core is attached to an outer surface of the cylinder liner 14 so as to form the water jacket 20, and the casting molds are arranged around the cylinder liner 14. Then molten aluminum alloy is filled in a cavity formed between the casting molds and the cylinder liner 14 so as to cast the cylinder block 10.

As mentioned above, in the present embodiment, the core 200 for forming the engaging portion 26 is formed separately from the outer mold pattern 230 for forming the outer surface of the cylinder liner 14. Thereafter, the core 200 and the outer mold pattern 230 are unitized so as to form the cylinder liner having a space which expands inside the cylinder liner like the engaging portion 26.

Figure 35:
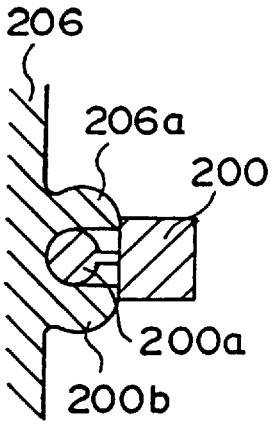
FIG. 35 is a cross-sectional view of an engaging portion between the core and the liner pattern for manufacturing the cylinder liner according to the second embodiment of the present invention.
Figure 36:
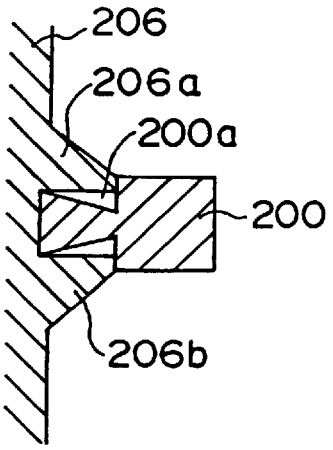
FIG. 36 is a cross-sectional view of an engaging portion between the core and the liner pattern for manufacturing the cylinder liner according to the third embodiment of the present invention.

It should be noted that, although in the present embodiment the cylinder liner 14 according to the first embodiment is manufactured, the cylinder liners according to other embodiments can be manufactured by changing a contour of the cross-section of the core 200 and the liner pattern 206. For example, when the cylinder liner 28 shown in FIG. 5 is manufactured, the outer surface configuration of the protrusions 206*a* and 206*b* of the liner pattern 206 is to be formed to correspond to the configuration of the protrusions 32 and 34 of the engaging portion 30 as shown in FIG. 35. Additionally, when the cylinder liner 44 shown in FIG. 6 is manufactured, the portion 200*a* of the core 200 and the protrusions 206*a* and 206*b* of the liner pattern 206 are to be formed as that shown in FIG. 36.

Figure 11:
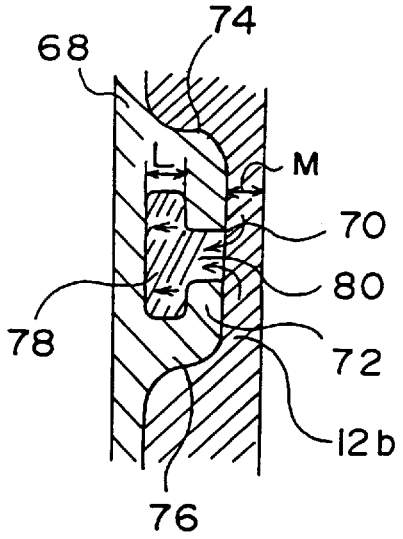
FIG. 11 is a cross-sectional view taken along a line XI—XI of FIG. 10.
Figure 37:
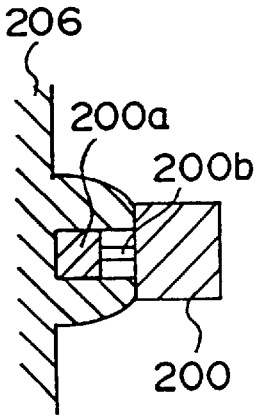
FIG. 37 is a cross-sectional view of an engaging portion between the core and the liner pattern for manufacturing the cylinder liner according to the fifth embodiment of the present invention.
Figure 38:
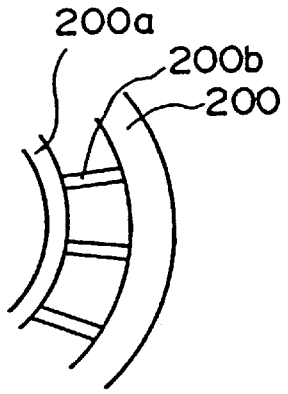
FIG. 38 is a plan view of a part of the core for manufacturing the cylinder liner according to the fifth embodiment of the present invention.

Additionally, when the cylinder liner 68 shown in FIG. 11 is manufactured, the portion 200*a* of the core 200 and the protrusions 206*a* and 206*b* of the liner pattern 206 are formed as shown in FIG. 37. In this case, the core 200 is to be formed to have a plurality of connecting portions 200*b* periodically arranged in a circumferential direction as shown in a plane view of FIG. 38.

Figure 12:
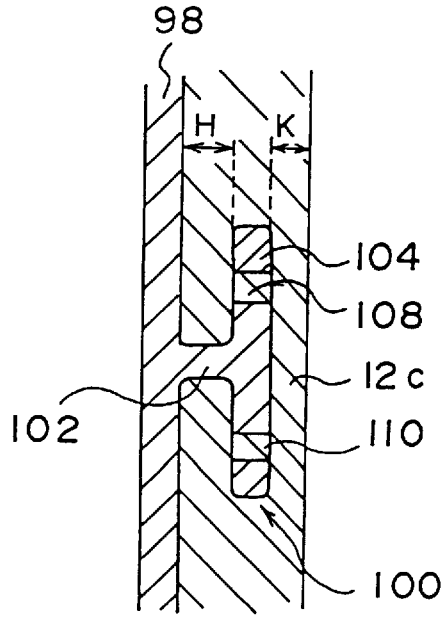
FIG. 12 is an enlarged cross-sectional view of an engaging portion provided to a cylinder liner of a seventh embodiment of the present invention.
Figure 39:
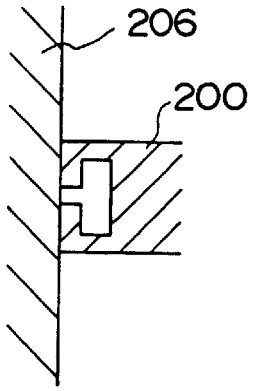
FIG. 39 is a cross-sectional view of an engaging portion between the core and the liner pattern for manufacturing the cylinder liner according to the seventh embodiment of the present invention.
Figure 40:
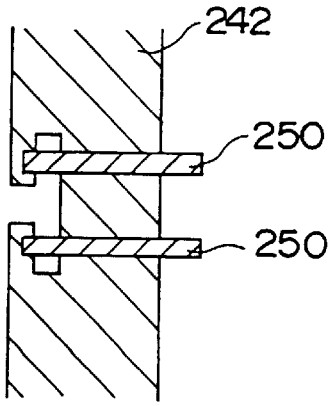
FIG. 40 is a cross-sectional view of a part of a liner mold pattern for explaining a method for forming openings in an engaging portion of the cylinder liner according to the seventh embodiment.

Further, when the cylinder liner 68 shown in FIG. 12 is manufactured, the core 200 and the liner pattern 206 are to be formed as that shown in FIG. 39. Then, when the cylinder liner 98 is cast by the liner mold pattern 242, piercing rods 250 are inserted into the liner mold pattern 242 as shown in FIG. 40.

The present invention is not limited to the specifically disclosed embodiments, and variations and modifications may be made without departing from the scope of the present invention.

What is claimed is:

1. A cylinder block of an internal combustion engine, comprising:

a cylinder block body made of a first material; and a cylinder liner cast in said cylinder block body, said cylinder liner made of a second material different from said first material, said cylinder liner having an engaging portion contacting a portion of said cylinder block body from outside in a radial direction of said cylinder liner; wherein said engaging portion comprises a protrusion protruding outwardly from an outer surface of said cylinder liner in a radial direction, said protrusion having an end extending in a direction of a longitudinal axis of said cylinder liner.

2. A cylinder block of an internal combustion engine, comprising:

a cylinder block body made of a first material; and a cylinder liner cast in said cylinder block body, said cylinder liner made of a second material different from said first material, said cylinder liner having an engaging portion contacting a portion of said cylinder block body from outside in a radial direction of said cylinder liner; wherein said engaging portion comprises a hollow space formed in said cylinder liner, said hollow space having an opening in an outer surface of said cylinder liner, an area of said hollow space being greater than an area of said opening when viewed in a radial direction of said cylinder liner.

3. A cylinder block of an internal combustion engine, comprising:

a cylinder block body made of a first material; and a cylinder liner cast in said cylinder block body, said cylinder liner made of a second material different from said first material, said cylinder liner having an engaging portion contacting a portion of said cylinder block body from outside in a radial direction of said cylinder liner; wherein said engaging portion includes a first protrusion and a second protrusion adjacent to said first protrusion, said first and second protrusions protruding outwardly from an outer surface of said cylinder liner, each of said first and second protrusions having an end portion extending in opposite directions toward each other in a direction of a longitudinal axis of said cylinder liner.

4. The cylinder block as claimed in claim 3, wherein each of said first and second protrusion has an undercut portion in an area connecting to the outer surface of said cylinder liner when viewed from outside in a radial direction of said cylinder liner.

5. The cylinder block as claimed in claim 3, wherein an uneven portion is provided to the outer surface of said cylinder liner between said first and second protrusions along a circumferential direction of said cylinder liner.

6. A cylinder block of an internal combustion engine, comprising:

a cylinder block body made of a first material; and a cylinder liner cast in said cylinder block body, said cylinder liner made of a second material different from said first material, said cylinder liner having an engaging portion contacting a portion of said cylinder block body from outside in a radial direction of said cylinder liner; wherein said engaging portion includes a first protrusion and a second protrusion adjacent to said first protrusion, said first and second protrusions protruding outwardly from an outer surface of said cylinder liner, said first and second protrusions slanting toward each other.

7. A cylinder block of an internal combustion engine, comprising:

a cylinder block body made of a first material; and a cylinder liner cast in said cylinder block body, said cylinder liner made of a second material different from said first material, said cylinder liner having an engaging portion contacting a portion of said cylinder block body from outside in a radial direction of said cylinder liner; wherein said engaging portion includes a circumferentially extending portion connected to an outer surface of said cylinder liner, said circumferentially extending portion being positioned a predetermined distance away from said outer surface of said cylinder liner in a radial direction of said cylinder liner, said circumferentially extending portion having a plurality of openings connecting outside and inside of said circumferentially extending portion.

8. The cylinder block as claimed in claim 7, wherein said predetermined distance is greater than a width of a portion of said cylinder block body positioned on the outside of said circumferentially extending portion, said width being measured in a radial direction of said cylinder liner.

9. The cylinder block as claimed in claim 7, wherein said circumferentially extending portion is connected to said cylinder liner at opposite sides thereof.

10. The cylinder block as claimed in claim 7, wherein said circumferentially extending portion is connected to said cylinder liner by a single rib at a middle position between opposite sides of said circumferentially extending portion.

11. The cylinder block as claimed in claim 7, wherein said circumferentially extending portion is connected to said cylinder liner by a plurality of ribs each of which extends in a direction parallel to a longitudinal axis of said cylinder liner.

12. The cylinder block as claimed in claim 7, wherein an uneven portion is provided on an outer surface of said cylinder liner in a portion contacting said cylinder block body in a circumferential direction.

13. A method for manufacturing a cylinder block of an internal combustion engine, comprising:

a cylinder block body made of a first material; and a cylinder liner cast in said cylinder block body, said cylinder liner made of a second material different from said first material, said cylinder liner having an engaging portion contacting a portion of said cylinder block body from outside in a radial direction of said cylinder liner, said method comprising:

a first step of placing a core in a predetermined position inside a mold, said core having an inner surface for forming said engaging portion;

a second step of die matching a liner pattern with respect to said core, said liner pattern having a contour substantially the same as said cylinder liner other than a portion corresponding to said engaging portion, said liner pattern comprising a combination of a plurality of pieces so that said liner pattern is die matched by positioning each of said pieces in a predetermined position inside said core;

a third step of forming an outer surface forming mold corresponding to an outer surface of said cylinder liner by filling a mold material in a cavity formed between said mold and each of said core and said liner pattern and solidifying the mold material in said cavity so as to unitize the mold material and said core;

a fourth step of removing said liner pattern from said mold;

a fifth step of placing an inner surface die in a predetermined position inside said outer surface forming mold, said inner surface die having a contour substantially the same as a contour of an inner surface of said cylinder liner;

a sixth step of forming a liner forming mold by filling a mold material in said inner surface die so as to form an inner surface mold having a contour substantially the same as the contour of the inner surface of said cylinder liner and solidifying the mold material in said inner surface die so as to unitize said outer surface forming mold and said inner surface forming mold; and a seventh step of casting said cylinder liner by filling molten metal in a cavity formed by said outer surface forming mold and said inner surface forming mold of said liner forming mold; and an eighth step of insertion casting said cylinder block with said cylinder liner inserted in said cylinder block.

14. The cylinder block of an internal combustion engine as claimed in claim 6, wherein said first and second protrusions align in a longitudinal direction of said cylinder liner.

* * * * *